US007565099B2

(12) United States Patent
Yamada et al.

(10) Patent No.: US 7,565,099 B2
(45) Date of Patent: Jul. 21, 2009

(54) DEVELOPING DEVICE AND IMAGE FORMING APPARATUS HAVING A TONER-PARTICLE BEARING ROLLER WITH A HELICAL GROOVE PORTION

(75) Inventors: Yoichi Yamada, Shiojiri (JP); Tomohiro Aruga, Shiojiri (JP); Noboru Sakurai, Chino (JP); Masanao Kunugi, Nagano-ken (JP); Katsumi Okamoto, Shiojiri (JP); Hiroshi Kato, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 331 days.

(21) Appl. No.: 11/554,460

(22) Filed: Oct. 30, 2006

(65) Prior Publication Data

US 2007/0110484 A1 May 17, 2007

(30) Foreign Application Priority Data

| | | |
|---|---|---|
| Oct. 31, 2005 | (JP) | 2005-317374 |
| Oct. 31, 2005 | (JP) | 2005-317376 |
| Oct. 31, 2005 | (JP) | 2005-317377 |
| Oct. 31, 2005 | (JP) | 2005-317378 |
| Dec. 28, 2005 | (JP) | 2005-379774 |

(51) Int. Cl.
*G03G 15/08* (2006.01)

(52) U.S. Cl. ..... 399/286

(58) Field of Classification Search ..... 399/265, 399/267, 276, 279, 286
See application file for complete search history.

(56) References Cited

U.S. PATENT DOCUMENTS

| | | | | |
|---|---|---|---|---|
| 5,387,966 | A * | 2/1995 | Karashima | 399/286 |
| 5,456,782 | A * | 10/1995 | Fujita et al. | 156/184 |
| 5,502,552 | A | 3/1996 | Iwata et al. | |
| 6,205,313 | B1 * | 3/2001 | Bean | 399/252 |

FOREIGN PATENT DOCUMENTS

| | | |
|---|---|---|
| JP | 01-102486 | 4/1989 |
| JP | 2000242073 A | 9/2000 |
| JP | 2003-263018 | 9/2003 |
| JP | 2005-084533 | 3/2005 |

* cited by examiner

*Primary Examiner*—Hoang Ngo
(74) *Attorney, Agent, or Firm*—Hogan & Hartson LLP

(57) ABSTRACT

A developing device includes a container that contains toner particles that are for developing a latent image borne by an image bearing body, and a toner-particle bearing roller that has a helical groove portion on a surface thereof that is for bearing the toner particles, the helical groove portion having an inclination with respect to an axial direction and a circumferential direction of the toner-particle bearing roller and being formed having a uniform pitch in the axial direction.

16 Claims, 22 Drawing Sheets

DEVELOPING DEVICE AND IMAGE FORMING APPARATUS HAVING A TONER-PARTICLE BEARING ROLLER WITH A HELICAL GROOVE PORTION

CROSS-REFERENCE TO RELATED APPLICATIONS

The present application claims priority from Japanese Patent Application No. 2005-317374 filed on Oct. 31, 2005, Japanese Patent Application No. 2005-317376 filed on Oct. 31, 2005, Japanese Patent Application No. 2005-317377 filed on Oct. 31, 2005, Japanese Patent Application No. 2005-317378 filed on Oct. 31, 2005, and Japanese Patent Application No. 2005-379774 filed on Dec. 28, 2005, which are herein incorporated by reference.

BACKGROUND

1. Technical Field

The present invention relates to developing devices and image forming apparatuses.

2. Related Art

As a developing device which performs development using toner particles, there is known a developing device including a toner-particle bearing roller which is for developing a latent image by bearing toner particles contained in a toner particle containing element.

In order to charge toner particles and to restrict the layer thickness of toner particles borne by the toner-particle bearing roller, such a developing device is furnished with a layer-thickness restriction member which abuts against the toner-particle bearing roller bearing the toner particles. A surface of the toner-particle bearing roller is sandblasted and has fine recesses and projections thereon. Toner particles are borne by the toner-particle bearing roller on the surface thereof and are pressed by the layer-thickness restriction member, and consequently the toner particles are charged by rolling while being rubbed by the surface having the recesses and projections or by the layer-thickness restriction member.

In such a developing device, if the recesses and projections of the surface of a toner-particle bearing roller are formed by sandblasting, the recesses are not uniform in size, depth, shape, and arrangement. Therefore, toner particles having entered a deep recess may not be charged satisfactorily because the toner particles are not caused to roll, for example. As mentioned above, due to non-uniformity of the recesses and projections on the surface of the toner-particle bearing roller, there are cases in which toner particles may not be charged satisfactorily in some areas or toner particles caught in small recesses may cause filming. Besides, if toner particles are not charged satisfactorily, there have been problems that the toner particles may spill from the developing device and result in scattering of the toner particles to the inside of an image forming apparatus, and that fog may occur in an image.

Note that JP-A-2003-263018, JP-A-1-102486, and JP-A-2005-84533 are examples of a related art.

SUMMARY

The present invention has been made in view of the above issues. An object of the present invention is to achieve a developing device which has a toner-particle bearing roller capable of causing toner particles to be charged satisfactorily.

Another aspect of the present invention is the following developing device.

A developing device includes:

a container that contains toner particles that are for developing a latent image borne by an image bearing body; and a toner-particle bearing roller that has a helical groove portion on a surface thereof that is for bearing the toner particles, the helical groove portion having an inclination with respect to an axial direction and a circumferential direction of the toner-particle bearing roller and being formed having a uniform pitch in the axial direction.

Other features of the present invention will become clear by the accompanying drawings and the description herebelow.

BRIEF DESCRIPTION OF THE DRAWINGS

For a more complete understanding of the present invention and the advantages thereof, reference is now made to the following description taken in conjunction with the accompanying drawings.

DESCRIPTION OF EXEMPLARY EMBODIMENTS

Figure 1:
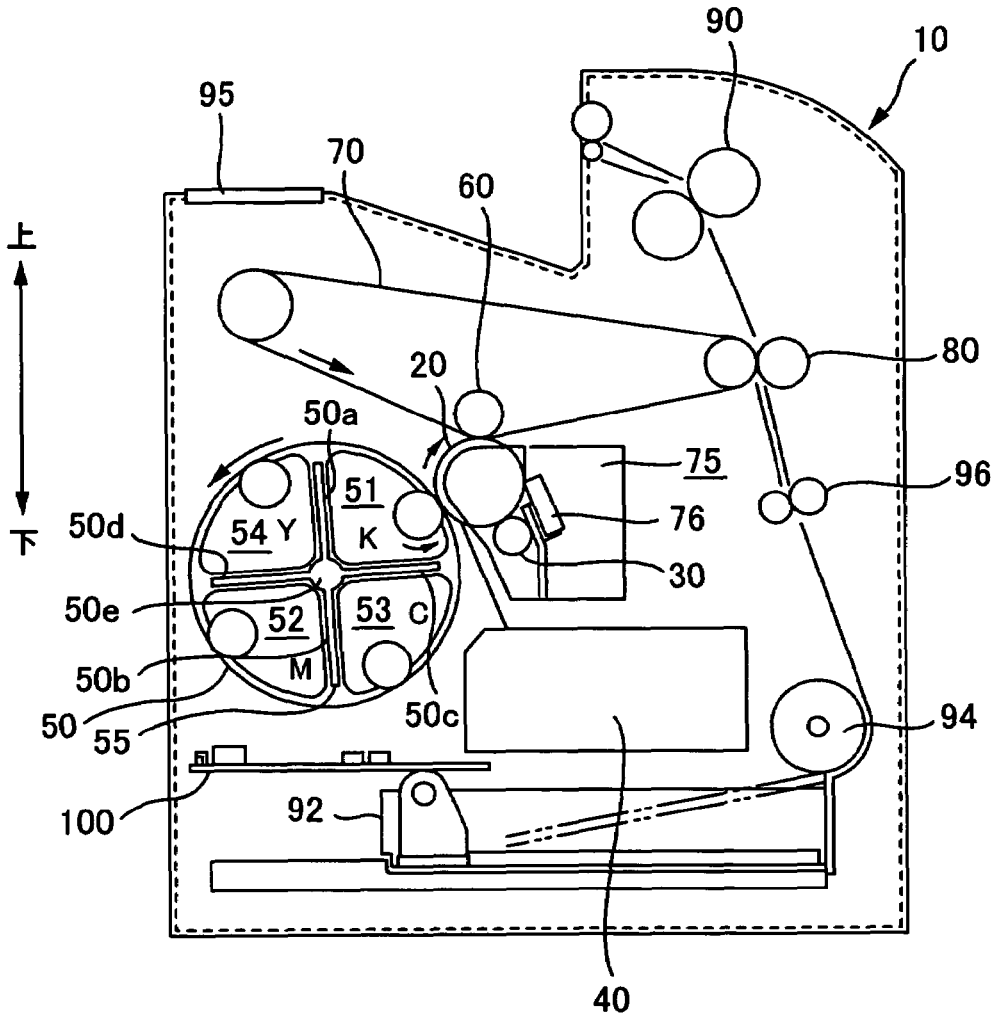
FIG. 1 is a diagram showing main components structuring a printer.

At least the following matters will be made clear by the description in the present specification and the accompanying drawings.

A developing device includes:

a container that contains toner particles that are for developing a latent image borne by an image bearing body; and a toner-particle bearing roller that has a helical groove portion on a surface thereof that is for bearing the toner particles, the helical groove portion having an inclination with respect to an axial direction and a circumferential direction of the toner-particle bearing roller and being formed having a uniform pitch in the axial direction.

The toner-particle bearing roller bears toner particles on the surface thereof and develops a latent image borne by an image bearing roller. In this case, if recesses and projections which are not uniform in size, depth, shape, etc. are formed on the surface of the toner-particle bearing roller, toner particles being borne and having entered a deep recess are resistant to rolling and to being charged, for example. In addition, if the groove portion is formed in the circumferential direction at a predetermined spacing in the axial direction, density of a developed toner image may become higher in an area which is positioned opposite the groove portion because a section of the image bearing body which is located opposite the groove portion does not change in position with respect to the axial direction. On the other hand, if the groove portion is formed along the axial direction at a predetermined spacing in the circumferential direction, the borne toner particles are especially resistant to rolling and to being charged because a rotating direction of the toner-particle bearing roller is substantially perpendicular to a direction of the groove portion.

With such a developing device which has a helical groove portion on a surface of a toner-particle bearing roller, the helical groove portion having an inclination with respect to an axial direction and a circumferential direction of the toner-particle bearing roller and having a uniform pitch in the axial direction, it is possible to charge toner particles satisfactorily by making toner particles roll and move with the rotation of the toner-particle bearing roller. Also, it is possible to reduce the occurrence of unevenness in density in the developed toner image because, with the rotation of the toner-particle bearing roller, a position at which the image bearing body and the groove portion are positioned opposite each other is successively changing with respect to the axial direction and the circumferential direction.

Also, a depth of the groove portion may be not more than twice as much as a volume-weighted average diameter of the toner particles.

With such a developing device, two or more of toner particles having entered the groove portion do not overlap in the depth direction inside the groove portion because the depth of the groove portion is not more than twice as much as the volume-weighted average diameter of the toner particles. Accordingly, it is possible to make toner particles in the groove portion roll evenly to charge them satisfactorily.

Also, the latent image may include dot-like latent images which are formed respectively in regions divided into lattices, the lattices may be able to be formed having a plurality of types of pitches in the axial direction, and a pitch of the groove portion in the axial direction may be shorter than a longest pitch among a plurality of the types of the pitches of the lattices.

With such a developing device, any of dots which develop the respective dot-like latent images is formed by a section which is a section of the toner-particle bearing roller and which includes the groove portion. Accordingly, it is possible to reduce the occurrence of unevenness in density which is caused in a developed toner image due to the groove portion.

Also, the toner-particle bearing roller may include both of end sections that are not to be processed and a central section, the central section having the groove portion that is provided in a depressed condition by a tool and having a projection portion that has a surface not contacted by the tool has; and the developing device further may comprise a layer-thickness restriction member that is for restricting a layer thickness of the toner particles borne by the toner-particle bearing roller, by abutting against the toner-particle bearing roller contiguously from the central section to both of the end sections.

With such a developing device, the top surface of the projection portion and a circumferential surface of both the end sections are located on a circumferential surface having a uniform radius from shaft center of the toner-particle bearing roller. Therefore, even if the layer-thickness restriction member for restricting the layer thickness of the toner particles abuts against the toner-particle bearing roller contiguously from the central section to both of the end sections, the layer-thickness restriction member does not bend greatly in the axial direction and does abut substantially flat. In short, because the layer-thickness restriction member does not bend greatly, it is possible to eliminate the occurrence of an opening between the toner-particle bearing roller and the layer-thickness restriction member. Besides, since the toner particles borne by the toner-particle bearing roller are pressed almost evenly by the layer-thickness restriction member, it becomes possible to charge the toner particles satisfactorily.

Also, two types of the groove portions may be formed, an angle of the inclination of each of the types being different with respect to the axial direction and the circumferential direction.

With such a developing device, the toner particles are moved in two directions along the groove portion because two types of the groove portions whose inclinations are different are formed on the toner-particle bearing roller. This enables to prevent toner particles from moving to a single predetermined direction and from being distributed unevenly.

Also, a distance from a top surface of the projection portion to a bottom surface of the groove portion may be uniform.

With such a developing device, an amount of the toner particles having entered the groove portion is almost even throughout the groove portion because the distance from the top surface of the projection portion to the bottom surface of the groove portion is uniform. This enables to make an amount of the toner particles borne by the toner-particle bearing roller almost even throughout the toner-particle bearing roller.

Also, the distance from the top surface of the projection portion to the bottom surface of the groove portion may be not more than twice as much as a volume-weighted average diameter of the toner particles.

With such a developing device, two or more of toner particles having entered the groove portion do not overlap in the depth direction inside the groove portion because the depth of the groove portion is not more than twice as much as the volume-weighted average diameter of the toner particles. This enables to make the toner particles in the groove portion roll evenly and consequently to charge them satisfactorily.

Also, the toner-particle bearing roller may include an indentation-processed section that is located on a central section in the axial direction of the toner-particle bearing roller, and whose surface is subject to an indentation process in order to bear the toner particles, a non-indentation-processed section that is located on both end sections in the axial direction of the toner-particle bearing roller, and whose surface is not subject to the indentation process, and an intervening section that is located between the indentation-processed section and the non-indentation-processed section in the axial direction of the toner-particle bearing roller, and whose radius is less than a maximum radius of the indentation-processed section and is more than a radius of the non-indentation-processed section; and the developing device may further comprise a layer-thickness restriction member that is for restricting a layer thickness of the toner particles borne by the toner-particle bearing roller, by abutting against the toner-particle bearing roller contiguously from one of the end sections in the axial direction of the toner-particle bearing roller to the other of the end sections.

In such a case, it is possible to achieve a developing device which appropriately restricts the layer thickness of the toner particles borne by the toner-particle bearing roller.

Also, the radius of the intervening section may be large on a side close to the indentation-processed section of the intervening section and is small on a side close to the non-indentation-processed section of the intervening section.

In such a case, it is possible to achieve a developing device which restricts the layer thickness of the toner particles borne by the toner-particle bearing roller more appropriately.

Also, the radius of the intervening section may become gradually smaller from the side close to the indentation-processed section of the intervening section to the side close to the non-indentation-processed section thereof.

In such a case, it is possible to achieve a developing device which appropriately restricts the layer thickness of the toner particles borne by the toner-particle bearing roller.

Also, the developing device may further comprise a sealing member that is for preventing spillage of the toner particles by contacting the non-indentation-processed section along a circumferential surface of the toner-particle bearing roller; and a surface of the intervening section may be not plated while a surface of the indentation-processed section is plated.

In such a case, it is possible to appropriately prevent spillage of toner particles as well as to improve toner-particle capability to be charged.

Also, the toner-particle bearing roller may include a grooved section on whose surface the groove portion is formed, a depth of the groove portion formed on an end section, of the above-mentioned grooved section, in the axial direction of the toner-particle bearing roller being less than a depth of the groove portion formed on a central section, of the above-mentioned grooved section, in the axial direction, and a non-grooved section that is located outside the grooved section in the axial direction and on which the groove portion is not formed; and the developing device may further comprise a sealing member that is for preventing spillage of the toner particles by contacting the non-grooved section along a circumferential surface of the toner-particle bearing roller.

In such a case, it is possible to achieve a developing device which appropriately prevents spillage of toner particles.

Also, the toner-particle bearing roller may include a grooved section on whose surface the groove portion is formed, an acute angle between the axial direction of the toner-particle bearing roller and a longitudinal direction of the groove portion formed on an end section of the grooved section in the axial direction being larger than an acute angle between the axial direction and a longitudinal direction of the groove portion formed on a central section of the grooved section in the axial direction, and a non-grooved section that is located outside the grooved section in the axial direction and on which the groove portion is not formed; and the developing device may further comprise a sealing member that is for preventing spillage of the toner particles by contacting the non-grooved section along a circumferential surface of the toner-particle bearing roller.

In such a case, it is possible to achieve a developing device which appropriately prevents spillage of toner particles.

Also, the toner-particle bearing roller may rotate in a predetermined rotating direction; the toner-particle bearing roller may include a grooved section on whose surface the groove portion is formed, wherein a first groove portion and a second groove portion that are different from each other in their respective twisting directions are formed as the groove portion in a central section, of the grooved section, in the axial direction of the toner-particle bearing roller, and wherein only either one of the first groove portion and the second groove portion is formed in an end section, of the grooved section, in the axial direction, and a non-grooved section that is located outside the grooved section in the axial direction and on which the groove portion is not formed; the developing device may further comprise a sealing member that is for preventing spillage of the toner particles by contacting the non-grooved section along a circumferential surface of the toner-particle bearing roller; and when, among two orientations that are along a longitudinal direction of the groove portion formed on the end section and that are oriented in opposite directions from one another, one orientation whose direction along the circumferential direction of the toner-particle bearing roller may be the same as the rotating direction is defined as a first orientation, among a direction from the end section towards the central section and a direction from the end section towards the non-grooved section, the latter is the same as a direction, of the first orientation, in the axial direction of the toner-particle bearing roller.

In such a case, it is possible to achieve a developing device which appropriately prevents spillage of toner particles.

Also, while a surface of the central section is plated, a surface of the end section may not be plated.

In such a case, it is possible to appropriately prevent spillage of toner particles as well as to improve toner-particle capability to be charged.

Also, the toner-particle bearing roller may include a grooved section on whose surface the groove portion is formed; and the developing device may further comprise a sealing member that prevents spillage of the toner particles by contacting the grooved section along a circumferential surface of the toner-particle bearing roller, and whose surface in contact with the grooved section is made of woven fabric.

In such a case, it is possible to appropriately prevent spillage of toner particles.

Also, the woven fabric may be pile fabric; pile yarns that are interwoven with base cloth of the pile fabric may be in contact with the grooved section; the pile yarns may be in contact with both end sections of the grooved section in the axial direction of the developer bearing roller; and a tip end of each of the pile yarns may point inwardly with respect to the axial direction.

In such a case, it is possible to prevent spillage of toner T more appropriately.

An image forming apparatus includes:

a developing device including a container that contains toner particles that are for developing a latent image borne by an image bearing body, and a toner-particle bearing roller that has a helical groove portion on a surface thereof that is for bearing the toner particles, the helical groove portion having an inclination with respect to an axial direction and a circumferential direction of the toner-particle bearing roller and being formed having a uniform pitch in the axial direction.

With such an image forming apparatus, it is possible to charge toner particles satisfactorily by making the toner particles roll and move with the rotation of the toner-particle bearing roller. In addition, it is possible to reduce the occurrence of unevenness in density on a developed toner image because, with the rotation of the toner-particle bearing roller, a position at which the image bearing body and the groove portion are positioned opposite each other is successively changing with respect to the axial direction and the circumferential direction.

Overview of Image Forming Apparatus

Figure 2:
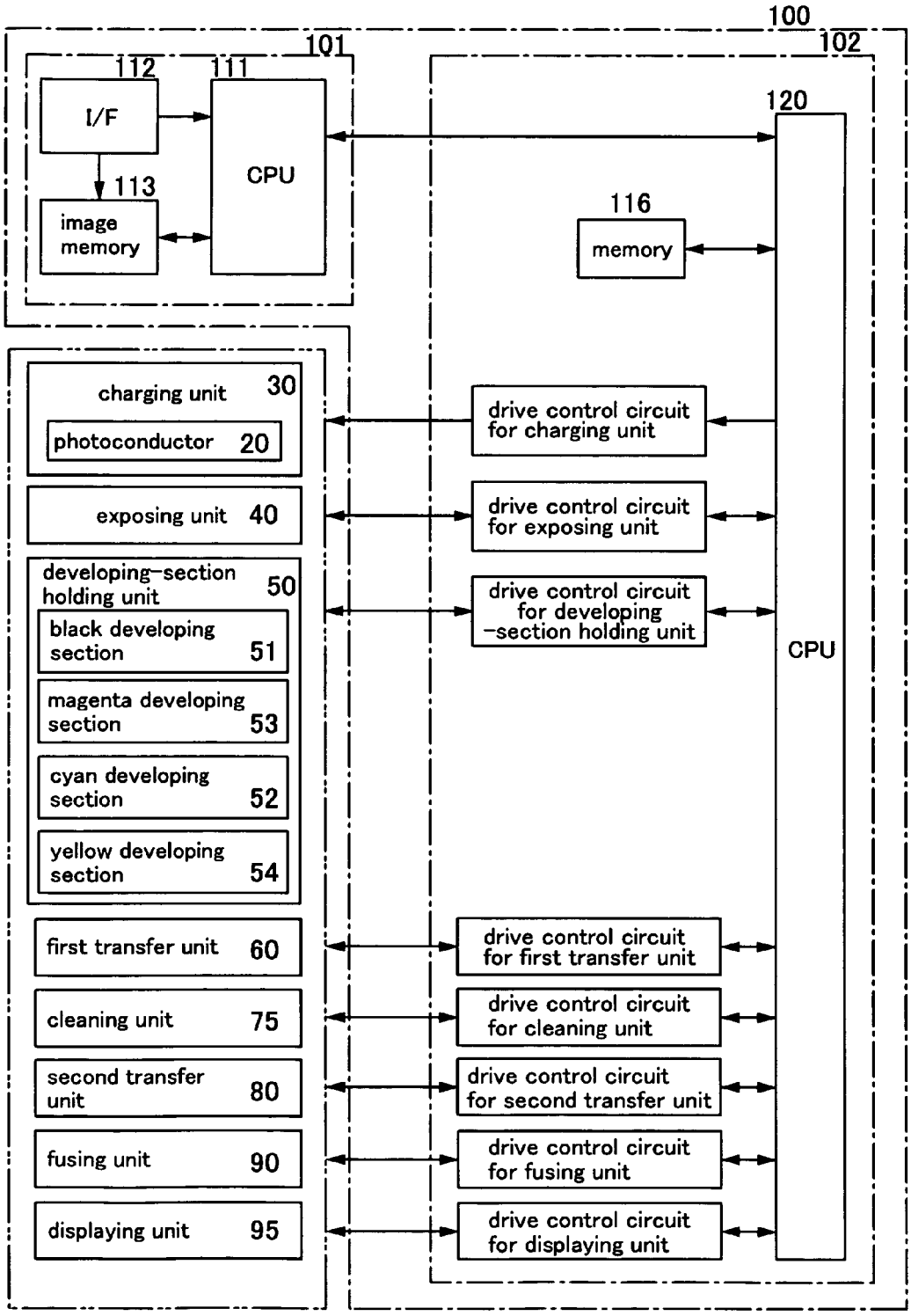
FIG. 2 is a diagram showing a configuration of a control unit provided on the printer.

Regarding an image forming apparatus which forms an image using a developing section as a developing device according to the present embodiment, examples of its configuration and operation are described for an example of a laser beam printer (hereinafter also referred to as a printer) 10, with reference to FIGS. 1 and 2. FIG. 1 is a diagram showing main components structuring the printer 10, and FIG. 2 is a diagram showing the configuration of a control unit provided on the printer 10. Note that, in FIG. 1, the arrow indicates the up-and-down direction, and that a paper supply tray 92 is arranged in the lower section of the printer 10 and a fusing unit 90 is arranged in the upper section of the printer 10, for example.

Configuration of Printer 10

As shown in FIG. 1, the printer 10 includes a charging unit 30, an exposing unit 40, a developing-section holding unit 50 (also referred to as a YMCK developing unit), a first transfer unit 60, an intermediate transfer body 70, and a cleaning unit 75, and they are provided along a rotating direction of a photoconductor 20 which serves as an example of an image bearing body bearing a latent image. In addition, the printer 10 includes a second transfer unit 80, the fusing unit 90, a displaying unit 95 which serves as means for making notifications to users and is constructed of a liquid-crystal panel, and a control unit 100 which controls these units, etc. and manages the operation as a printer.

The photoconductor 20 has a cylindrical conductive base and a photoconductive layer formed on an outer peripheral surface of the base, and it is rotatable about its central axis. In the present embodiment, the photoconductor 20 rotates clockwise, as indicated by the arrow in FIG. 1.

The charging unit 30 is a device for charging the photoconductor 20. The exposing unit 40 is a device which forms a latent image on the charged photoconductor 20 by radiating a laser beam thereon. The exposing unit 40 has a semiconductor laser for emitting laser beam (light), a polygon mirror unit making a polygonal polygon mirror rotate, and a plurality of types of lens such as an F-θ lens, and radiates modulated laser beam onto the charged photoconductor 20 according to image signals having been input from a not-shown host computer such as a personal computer or a word processor. At this stage, the laser beam emitted by the semiconductor laser is radiated onto the polygon mirror. The laser beam radiated onto the polygon mirror scans the photoconductor 20 through the lens, while the reflection angle of the laser beam changing by rotation of the polygon mirror. The laser beam is turned ON and OFF at a predetermined timing, and dot-like latent images are formed on the photoconductor 20 in regions divided into lattice cells, the photoconductor 20 rotating at a predetermined speed. The latent image consists of these dot-like latent images. The dot-like latent images are not visible to the unaided eye because they serve for forming the latent image.

The developing-section holding unit 50 is a device for developing the latent image formed on the photoconductor 20, using toner particles (hereinafter also referred to as toner) T which serve as an example of developer contained in developing sections 51, 52, 53, 54 as an example of a developing device, that is, using black (K) toner contained in a black developing section 51, magenta (M) toner contained in a magenta developing section 52, cyan (C) toner contained in a cyan developing section 53, and yellow (Y) toner contained in a yellow developing section 54.

In the present embodiment, the developing-section holding unit 50 enables to move the positions of the four developing sections 51, 52, 53, 54 by its rotation. More specifically, the developing-section holding unit 50 holds the four developing sections 51, 52, 53, 54 with four attach/detach sections (holders) 50*a*, 50*b*, 50*c*, 50*d*, and the above-mentioned four developing sections 51, 52, 53, 54 are rotatable about a central axis 50*e* while keeping their respective positions relatively. Every time an image forming process for one page is finished, the four developing sections 51, 52, 53, 54 are selectively located opposite the photoconductor 20, and successively develop the latent image formed on the photoconductor 20, using toner which is contained in each of the developing sections 51, 52, 53, 54. Note that each of the above-mentioned four developing sections are attachable to and detachable from the attach/detach sections of the developing-section holding unit 50. Details of each developing section will be described later.

The first transfer unit 60 is a device for transferring a single-color toner image formed on the photoconductor 20, onto the intermediate transfer body 70. When toners of four colors are successively transferred in a superposed manner, a full-color toner image is formed on the intermediate transfer body 70. The intermediate transfer body 70 is an endless belt, and is driven and rotated at the approximately same circumferential speed as the photoconductor 20. The second transfer unit 80 is a device for transferring the single-color toner image or the full-color toner image formed on the intermediate transfer body 70, onto a medium (a recording medium) such as paper (a recording paper), film, and cloth.

The fusing unit 90 is a device for fusing, onto the recording medium, the single-color toner image or the full-color toner image which has been transferred onto the recording medium, to make the image into a permanent image. The cleaning unit 75 is provided between the first transfer unit 60 and the charging unit 30, and has a cleaning blade 76 which is made of rubber and made to abut against the surface of the photoconductor 20. The cleaning unit 75 is a device for removing toner T which remains on the photoconductor 20, by scraping it off with the cleaning blade 76 after the toner image has been transferred onto the intermediate transfer body 70 by the first transfer unit 60.

The control unit 100 is configured by a main controller 101 and a unit controller 102, as shown in FIG. 2. Image signals and control signals are input to the main controller 101, and according to instructions based on these image signals and control signals, the unit controller 102 controls each of the above-mentioned units, etc. to form an image.

The main controller 101 is electrically connected to the host computer through an interface 112, and is furnished with an image memory 113 for storing image signals sent by the host computer, a CPU 111 for managing entire control of the printer 10 and the like.

The unit controller 102 includes, for example, a CPU 120, a memory 116 such as a RAM and a ROM, and drive control circuits each for driving and controlling the respective units in the body of the apparatus (the charging unit 30, the exposing unit 40, the first transfer unit 60, the cleaning unit 75, the second transfer unit 80, the fusing unit 90, and the displaying unit 95) and the developing-section holding unit 50, and the unit controller 102 controls the units based on the signals which are input from the main controller 101.

Operation of Printer 10

Next, operation of the printer 10 is described giving consideration to other structural components as well.

When the image signals and the control signals are input from the not-shown host computer through the interface (I/F) 112 to the main controller 101 of the printer 10, the photoconductor 20, a developing roller 510, and the intermediate transfer body 70 rotate under the control of the unit controller 102 according to the instructions from the main controller 101, the developing roller 510 being provided on each of the developing sections 51, 52, 53, 54. With rotating, the photoconductor 20 is successively charged by the charging unit 30 at a charging position.

With the rotation of the photoconductor 20, the charged area of the photoconductor 20 reaches an exposing position. A latent image which corresponds to image information for a first color, for example yellow Y, is formed by the exposing unit 40. At this time, in the developing-section holding unit 50, the yellow developing section 54 containing yellow (Y) toner is located at a developing position in opposition to the photoconductor 20.

With the rotation of the photoconductor 20, the latent image formed on the photoconductor 20 reaches the developing position, and is developed by the yellow developing section 54 using yellow toner. Thereby, a yellow toner image is formed on the photoconductor 20.

With the rotation of the photoconductor 20, the yellow toner image formed on the photoconductor 20 reaches a first transfer position, and is transferred onto the intermediate transfer body 70 by the first transfer unit 60. At this time, a first transfer voltage, which is in an opposite polarity to the polarity to which the toner is charged, is applied to the first transfer unit 60. Note that, during this time, the photoconductor 20 and the intermediate transfer body 70 are placed in contact with each other and the second transfer unit 80 is separated from the intermediate transfer body 70.

By performing repeatedly the above-mentioned process for a second color, a third color, and a fourth color respectively, toner images in four colors associated with the respective image signals are transferred onto the intermediate transfer body 70 in a superposed manner. Thereby, a full-color toner image is formed on the intermediate transfer body 70.

With the rotation of the intermediate transfer body 70, the full-color toner image formed onto the intermediate transfer body 70 reaches a second transfer position, and is transferred onto the recording paper serving as a recording medium by the second transfer unit 80. Note that the recording paper is carried from the paper supply tray 92 to the second transfer unit 80 through a paper supply roller 94 and resisting rollers 96. During the transfer operation, a second transfer voltage is applied to the second transfer unit 80, the second transfer unit 80 being pressed against the intermediate transfer body 70.

The full-color toner image transferred onto the recording paper is heated and pressurized by the fusing unit 90 and is fused to the recording paper. On the other hand, after the photoconductor 20 has passed the first transfer position, toner remaining on (adhering to) the surface thereof is scraped off by the cleaning blade 76, and the photoconductor 20 is prepared for charging which is for formation of a next latent image. The scraped toner is collected by a waste toner container (a residual toner collector) included in the cleaning unit 75.

Overview of Developing Section

Figure 3:
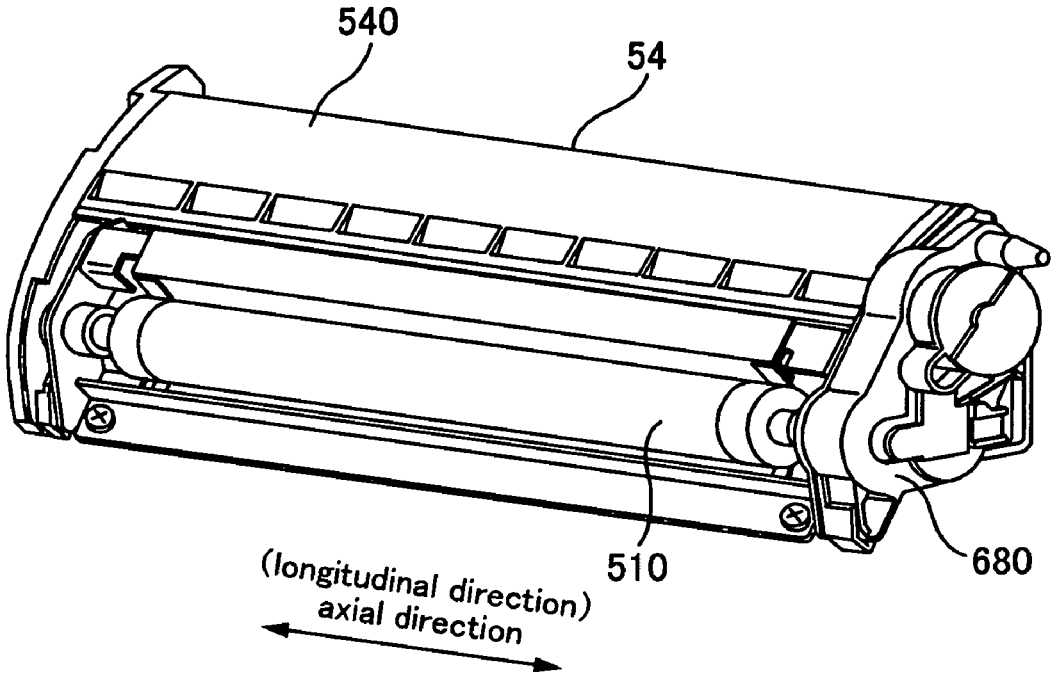
FIG. 3 is a perspective view of a yellow developing section.
Figure 4:
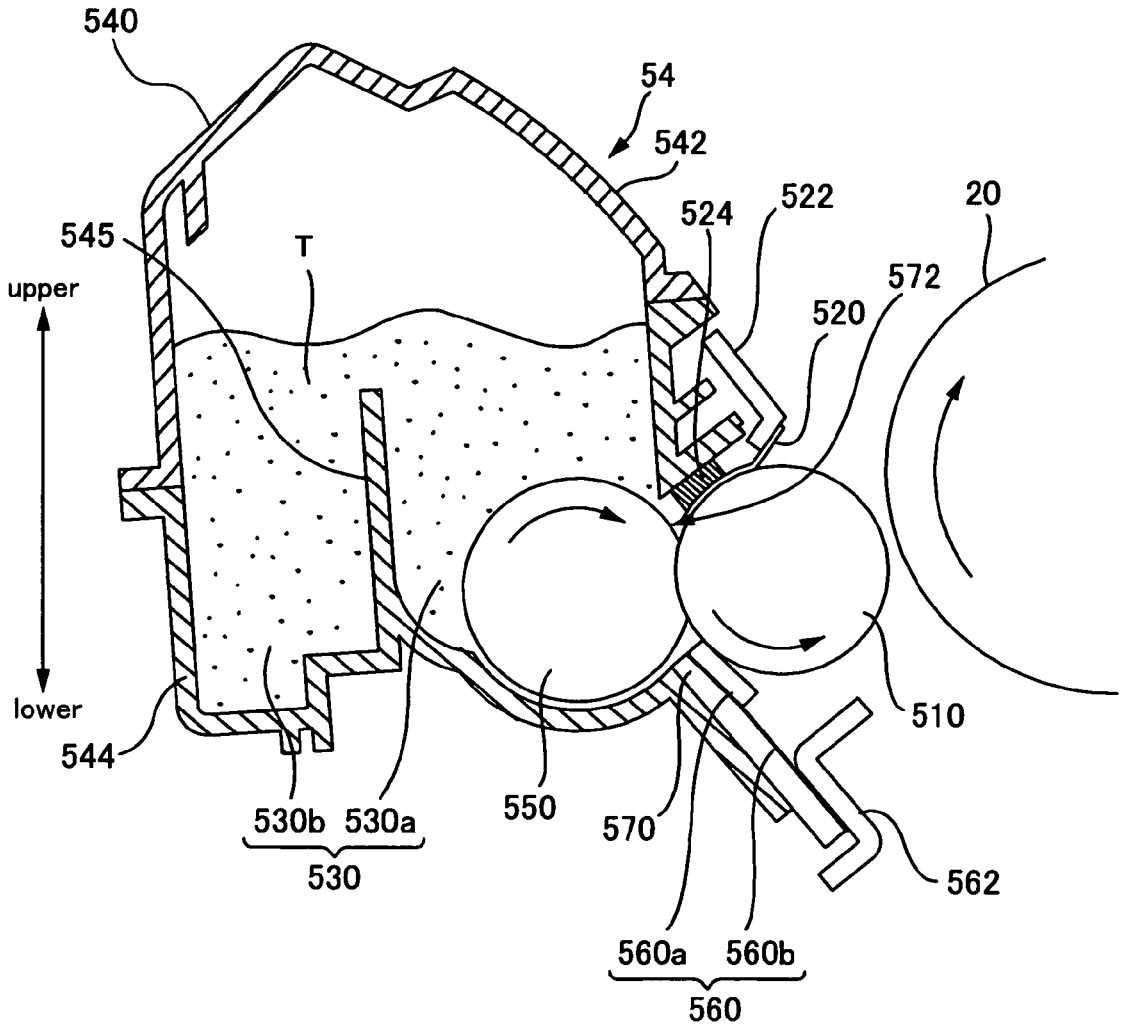
FIG. 4 is a cross-sectional view showing main components structuring the yellow developing section.
Figure 5:
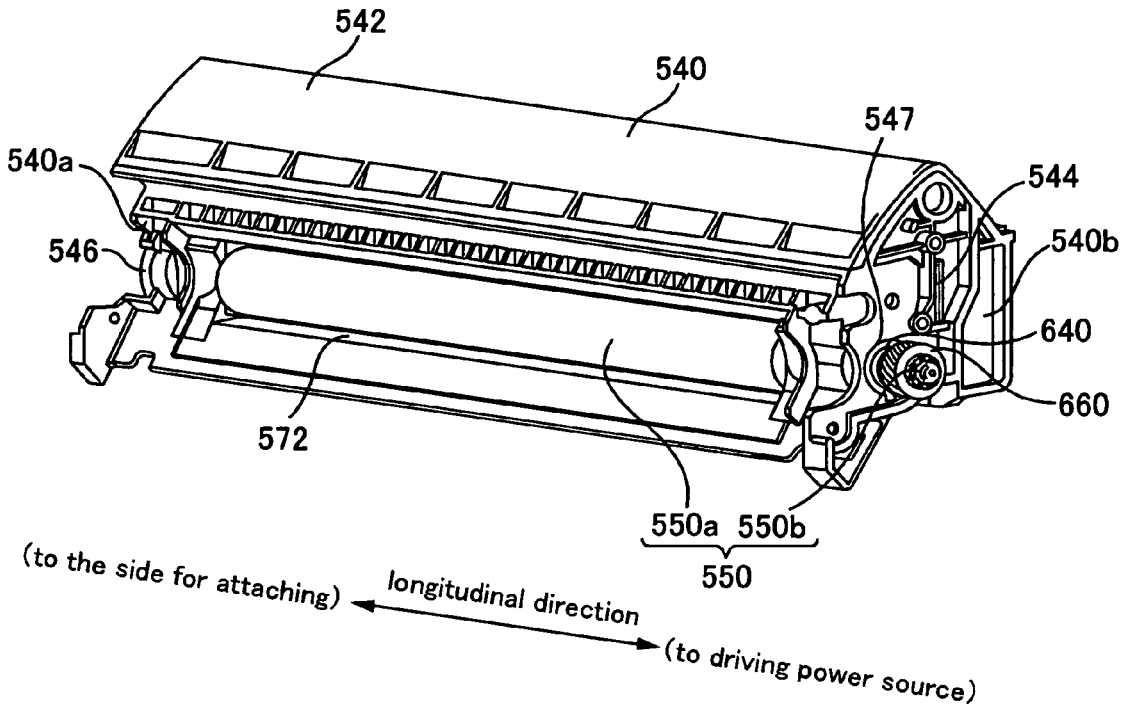
FIG. 5 is a perspective view showing a developing section from which a developing roller is detached.

Next, a configuration example of the developing section is described with reference to FIGS. 3 through 5. FIG. 3 is a perspective view of the yellow developing section. FIG. 4 is a cross-sectional view showing main components structuring the yellow developing section. FIG. 5 is a perspective view showing the developing section from which the developing roller is detached. Note that the cross-sectional view shown in FIG. 4 is a diagram showing a cross-section of the yellow developing section when cut by a plane perpendicular to the longitudinal direction shown in FIG. 3. In FIG. 4, in the same way as FIG. 1, the up-and-down direction is indicated by an arrow, and a central axis of the developing roller 510 is located below a central axis of the photoconductor 20, for example. Further, in FIG. 4, the yellow developing section 54 is shown being located at the developing position in opposition to the photoconductor 20.

The developing-section holding unit 50 is furnished with the black developing section 51 containing black (K) toner, the magenta developing section 52 containing magenta (M) toner, the cyan developing section 53 containing cyan (C) toner, and the yellow developing section 54 containing yellow (Y) toner. However, only the yellow developing section 54 is described below because the configuration of the developing sections is substantially same.

Configuration of Yellow Developing Section 54

The yellow developing section 54 includes a housing 540 containing toner T, the developing roller 510 which serves as an example of a toner-particle bearing roller for bearing toner, a toner supply roller 550 for supplying the developing roller 510 with toner, a restriction blade 560 which serves as an example of a layer-thickness restriction member for restricting the layer thickness of toner borne by the developing roller 510, an upper seal 520 for sealing an upper opening between the housing 540 and the developing roller 510, end-section seals 527 for sealing an opening which is between the housing 540 and the developing roller 510 and which is located on the side of end sections of the developing roller 510, and the like.

The housing 540 is manufactured by welding together a housing upper section 542 and a housing lower section 544 which are made of integrally-molded resin, and a toner container 530 as a container for containing toner T is formed in the housing 540. The toner container 530 is separated into two toner containers, that is, a first toner container **530*a* and a second toner container 530*b* by a partitioning wall 545 which protrudes inwardly from an inner wall (to the up-and-down direction in FIG. 4**) and is for separating toner T.

The first toner container **530*a* and the second toner container 530*b* are connected to each other with their respective upper sections. In the state shown in FIG. 4, the partitioning wall 545 restricts movement of toner T. However, when the developing-section holding unit 50 rotates, toner contained in the first toner container 530***a* and in the second toner container 530*b* is once gathered in the connected section on the upper side in the developing position. When returning to a state shown in FIG. 4, the toner is mixed and is moved back to the first toner container 530*a* and the second toner container 530*b*. In other words, by rotation of the developing-section holding unit 50, toner T in developing section is stirred. Therefore, in the present embodiment, the toner container 530 is not furnished with a stirring member, but it is possible to provide a stirring member for stirring toner T contained in the toner container 530. As shown in FIG. 4, the housing 540 includes an opening 572 in the lower section thereof, and the developing roller 510 to be described later is provided facing the opening 572.

The toner supply roller 550 is structured by an elastic roller section 550*a* which is formed with, for example, urethane foam and a shaft body 550*b* which works as the center of rotation of the roller section 550*a*. The toner supply roller 550 is supported by the housing 540 at both ends of the shaft body 550*b*, and thereby is supported rotatably around the shaft body 550*b*. The roller section 550*a* is accommodated in the above-mentioned first toner container 530*a* of the housing 540 (inside the housing 540), and supplies the developing roller 510 with toner T contained in the first toner container 530*a*. The toner supply roller 550 is provided vertically below the first toner container 530*a*. At the lower section of the first toner container 530*a*, toner T contained in the first toner container 530*a* is supplied by the toner supply roller 550 to the developing roller 510. In addition, after developing, the toner supply roller 550 strips off excessive toner T remaining on the developing roller 510 from the developing roller 510.

The toner supply roller 550 and the developing roller 510 are mounted on the housing 540 with them being pressed against each other. Therefore, the roller section 550*a* of the toner supply roller 550 abuts against the developing roller 510 while being deformed elastically. Further, the toner supply roller 550 rotates in a direction (clockwise in FIG. 4) opposite a rotating direction of the developing roller 510 (counterclockwise in FIG. 4). The shaft body 550*b* is located below a central axis of rotation of the developing roller 510.

The developing roller 510 bears toner T to carry it to the developing position opposite the photoconductor 20. The developing roller 510 is made of metal and is manufactured with aluminum alloy such as 5056 aluminum alloy and 6063 aluminum alloy and iron alloy such as STKM. The developing roller 510 can be nickel-plated, chrome-plated, etc. as necessary. A surface of the developing roller 510 is furnished with a groove-like recess formed helically (a helical groove portion) in a central section in an axial direction of the developing roller 510. The form of the surface of the developing roller 510 will be described in greater detail later.

Besides, the developing roller 510 is supported at both of the end sections in a longitudinal direction thereof, as shown in FIG. 3, and is rotatable about its central axis. As shown in FIG. 4, the developing roller 510 rotates in a direction (counterclockwise in FIG. 4) opposite to the rotating direction of the photoconductor 20 (clockwise in FIG. 4). The central axis is located below the central axis of the photoconductor 20.

Further, as shown in FIG. 4, when the yellow developing section 54 is located opposite the photoconductor 20, a gap exists between the developing roller 510 and the photoconductor 20. More specifically, the yellow developing section 54 develops, without contacting, the latent image formed on the photoconductor 20. Note that, when the latent image formed on the photoconductor 20 is developed, alternating electric field is generated between the developing roller 510 and the photoconductor 20.

Abutting against the developing roller 510 contiguously from one of the end sections in the axial direction of the developing roller 510 to the other of the end sections, the restriction blade 560 provides electrical charges to toners T borne by the developing roller 510, and also restricts the layer thickness of toners T borne by the developing roller 510. The restriction blade 560 includes a rubber section 560*a* and a rubber supporting section 560*b*. The rubber section 560*a* is made of silicone rubber, urethane rubber, etc., and the rubber supporting section 560*b* is a thin plate which is made of phosphor bronze, stainless steel, etc. and which has a spring-like characteristic. The rubber section 560*a* is mounted along a longitudinal direction of the rubber supporting section 560*b*, and is supported on the side of one end of the rubber supporting section 560*b* in a lateral direction thereof. The rubber supporting section 560*b* is mounted on the housing 540 through a blade-supporting metal plate 562 while the other end of the rubber supporting section 560*b* is supported by the blade-supporting metal plate 562. Besides, a blade back member 570 made of Moltoprene etc. is provided on the restriction blade 560 on a side opposite from the side of the developing roller 510.

Here, the rubber section 560*a* is pressed against the developing roller 510 contiguously from the central section to both of the end sections, by elastic force which is due to bending of the rubber supporting section 560*b*. Further, the blade back member 570 prevents toner T from entering between the rubber supporting section 560*b* and the housing 540, and stabilizes elastic force which is due to bending of the rubber supporting section 560*b*. In addition thereto, the blade back member 570 presses the rubber section 560*a* against the developing roller 510 by urging the rubber section 560*a* from the back of the rubber section 560*a* towards the developing roller 510. Accordingly, the blade back member 570 makes the rubber section 560*a* abut more evenly against the developing roller 510.

An opposite end of the restriction blade 560 which is located opposite the end supported by the blade-supporting metal plate 562, that is, an edge is not in contact with the developing roller 510, but a section located a predetermined distance from the edge is in contact with the developing roller 510 over a certain width. In other words, the restriction blade 560 does not abut, at the edge thereof, against the developing roller 510, but abuts with a flat surface of the rubber section 560*a* in surface-to-surface contact. Besides, the restriction blade 560 is arranged such that its edge points towards the upstream side of the rotating direction of the developing roller 510, and makes a so-called counter-abutment with respect to the developing roller 510. Note that an abutting position at which the restriction blade 560 abuts against the developing roller 510 is located lower than the central axis of the developing roller 510, and lower than the central axis of the toner supply roller 550.

Furthermore, the rubber supporting section 560*b* is provided such that, in the axial direction of the developing roller 510, it is longer than the rubber section 560*a*, and is extended outwardly beyond both ends of the rubber section 560*a* respectively. The end-section seals 527 which are thicker than the rubber section 560*a* and are made, for example, of non-woven fabric are made to stick to the extended sections of the rubber supporting section 560*b* on the same surface as the rubber section 560*a*. In this case, each side surface of the rubber section 560*a* in the axial direction thereof abuts against a side surface of the end-section seal 527.

By contacting the developing roller 510 along a circumferential surface thereof, the end-section seal 527 serves to eliminate spillage of toner T from between the housing 540 and the circumferential surface of the developing roller 510. The end-section seals 527 are provided such that, when the developing roller 510 is attached, the end-section seals 527 abut respectively against both end sections of the developing roller 510, which do not have the groove portion on the surface of the developing roller 510. The end-section seals 527 each has a width sufficient to reach beyond the respective end sections of the developing roller 510. Besides, each end-section seal 527 is extended beyond the edge of the rubber section 560*a* of the restriction blade 560 to a sufficient extent. If the restriction blade 560 is mounted on the housing 540, the end-section seal 527 closes the opening between the housing 540 and the developing roller 510 by being positioned along a section of the housing 540, the housing 540 being formed to be located opposite an outer peripheral surface of the developing roller 510.

The upper seal 520 prevents toner T in the yellow developing section 54 from spilling outside, and collects, into the developing section, toner T which has passed through the developing position and is on the developing roller 510, without scraping off the toner T. The upper seal 520 is a seal made of polyethylene film, etc. The upper seal 520 is supported by a seal-supporting metal plate 522, and is mounted on the housing 540 through the seal-supporting metal plate 522. Besides, a seal urging member 524 made of Moltoprene, etc. is provided on the upper seal 520 on a side opposite from the side of the developing roller 510. The upper seal 520 is pressed against the developing roller 510 by elastic force of the seal urging member 524. Note that the abutting position where the upper seal 520 abuts against the developing roller 510 is located above the central axis of the developing roller 510.

Operation of Yellow Developing Section 54

In the yellow developing section 54 constructed as mentioned above, the toner supply roller 550 supplies, to the developing roller 510, toner T contained in the toner container 530. With the rotation of the developing roller 510, the toner T supplied to the developing roller 510 reaches the abutting position of the restriction blade 560; on passing through the abutting position, the toner T is charged electrically and the layer thickness is restricted.

With further rotation of the developing roller 510, the charged toner T on the developing roller 510 reaches the developing position which is located opposite the photoconductor 20, and is used at the developing position in development of a latent image formed on the photoconductor 20 under alternating electric field. The toner T on the developing roller 510 which has passed through the developing position with further rotation of the developing roller 510 passes through the upper seal 520, and the toner T is collected into the developing section without being scraped off by the upper seal 520. Furthermore, toner T still remaining on the developing roller 510 can be stripped off by the toner supply roller 550.

Form of Surface of Developing Roller

Figure 6:
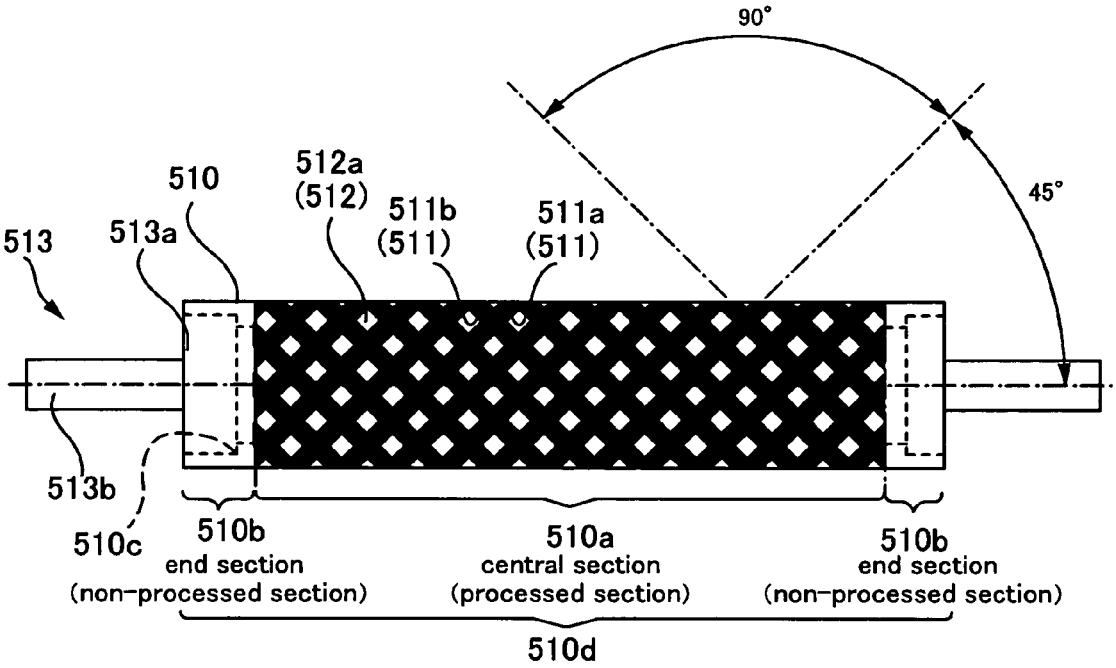
FIG. 6 is a diagram conceptually showing a form of a surface of the developing roller.
Figure 7:
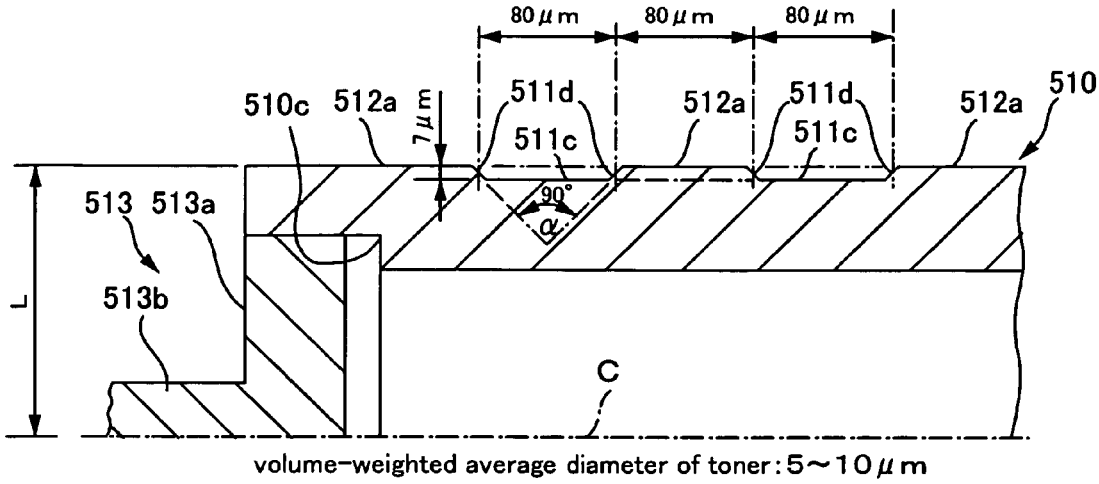
FIG. 7 is a cross-sectional view for describing a cross-section of the developing roller when cut by a flat plane on which the axis exists.

FIG. 6 is a diagram conceptually showing a form of a surface of the developing roller. FIG. 7 is a cross-sectional view for describing a cross-section of the developing roller when cut by a flat plane on which the axis exists. In FIG. 6, each of the groove portions on the surface of the developing roller 510 is indicated by straight lines for the sake of convenience, but the groove portion is actually formed to seem to be curved because it is formed helically.

The developing roller 510 has recesses and projections which are for bearing toner particles with a central section 510*a* thereof in the axial direction, and has smooth circumferential surfaces on both of end sections 510*b* such that the end-section seal 527 is attached closely thereto.

As shown in FIG. 6, on the central section 510*a* of the developing roller 510 in the present embodiment, helical groove portions 511 are formed at a uniform pitch in the axial direction of the developing roller 510 and are inclined with respect to the axial direction and the circumferential direction of the developing roller 510. Two types of the groove portions 511 are formed, and their respective inclinations with respect to the axial direction and the circumferential direction of the developing roller 510 are different. The two types of the groove portions 511 intersect to form lattices, and are formed such that a top surface 512*a* of a projection portion 512 surrounded by the two types of the groove portions 511 is substantially similar to a square. Besides, the two types of the groove portions 511 are formed such that either one of two diagonal lines included in the square of the top surface 512*a* of the projection portion 512 is in the circumferential direction.

More specifically, either one of the two types of the groove portions 511 is formed helically such that it and an axis of the developing roller 510 make an angle of 45° clockwise, and the other is formed helically such that it and an axis of the developing roller 510 make an angle of 45° counterclockwise. Therefore, an angle at which the one groove portion 511*a* and the other groove portion 511*b* intersect is 90°. Besides, the top surface 512*a* of the projection portion 512 surrounded by the two types of the groove portions is in an approximately square shape because the one groove portion 511*a* and the other groove portion 511*b* are formed at equal pitches in the axial direction of the developing roller 510.

The two types of the groove portions 511 are formed respectively every 80 μm in the axial direction of the developing roller 510 as shown in FIG. 7. An angle of an inclined portion 511*d* which extends from the top surface 512*a* of the projection portion 512 to a bottom surface 511*c* of the groove portion 511 is formed such that a crossing angle $\alpha$ of an imaginary surface formed by extending two inclined surfaces forming the groove portions 511 towards shaft center C is 90°.

Besides, the groove portions 511 are formed such that the depth of the groove portion 511, that is, a distance from the top surface 512*a* of the projection portion 512 and the bottom surface 511*c* of the groove portions 511 is uniform, approximately 7 μm. Here, the volume-weighted average diameter of toner is approximately 5 to 10 μm, and the depth of the groove portions 511 is designed to be not more than twice as much as the volume-weighted average diameter of toner.

Figure 8:
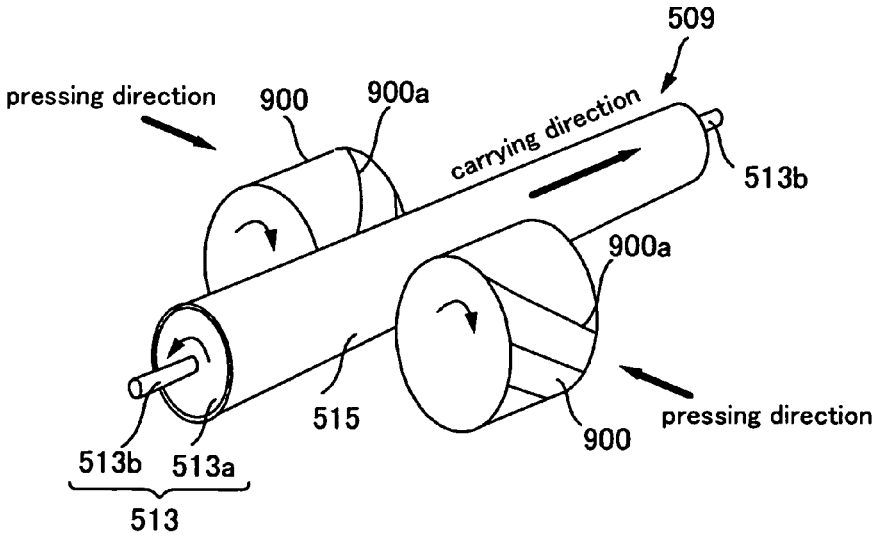
FIG. 8 is a diagram for describing how the developing roller is formed by rolling.
Figure 9:
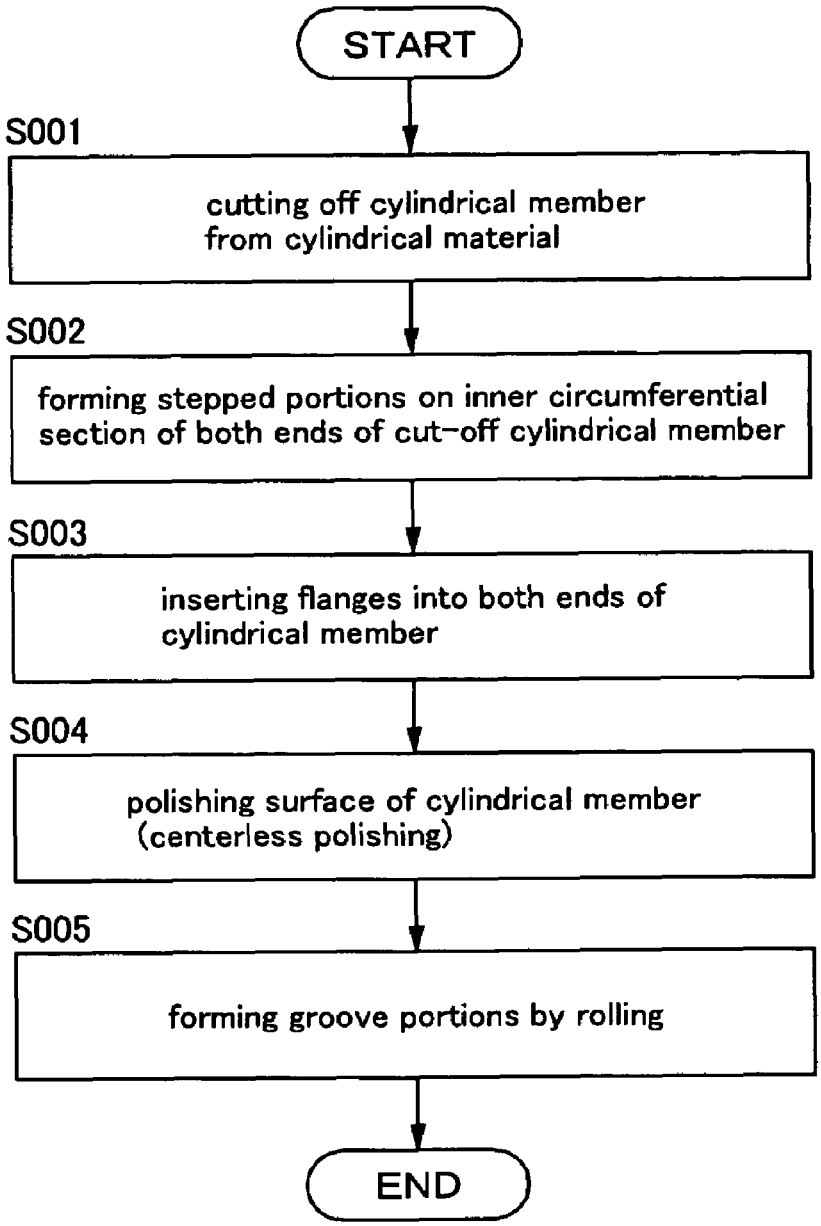
FIG. 9 is a flowchart showing processes in which the developing roller is formed.

This type of the developing roller 510 is formed by rolling. FIG. 8 is a diagram for describing how the developing roller 510 is formed by rolling. FIG. 9 is a flowchart showing processes in which the developing roller is formed.

The developing roller 510 is formed with a hollow cylindrical material.

A cylindrical material is cut to a length sufficient to form the central section 510*a* which is for bearing toner as the developing roller 510 and the end sections 510*b* which the end-section seals 527 abut against, and a cylindrical member 515 is cut off (S001). On the cylindrical member 515, stepped portions 510*c* (FIG. 6) are formed by machining (S002), the stepped portions 510*c* being for inserting a flange 513 which has a shaft of the developing roller 510, into the inner circumferential section of both of the end sections of the cylindrical member 515. At this stage, each flange 513 includes a disk-like flange body 513*a* whose diameter enables the flange body

513*a* to be pressed into the formed stepped portion 510*c*, and includes a shaft 513*b* which is provided in a protruding condition at the center of the flange body 513*a* so as to be perpendicular to the disk of the flange body 513*a*.

Next, each of the flanges 513 including the shaft 513*b* is inserted into the cylindrical member 515 such that the shafts 513*b* extends outwardly beyond the cylindrical member (S003), the cylindrical member 515 having the stepped portions 510*c* which are formed inside both of the end sections of the cylindrical member 515.

Thereafter, the shafts 513*b* on both ends of the cylindrical member 515 into which the flanges 513 have been inserted are supported and are rotated about an axis. By machining slightly an entire outer peripheral surface of the cylindrical member 515, the surface of the cylindrical member 515 is polished such that all areas of the surface have the same center as the shaft, that is, such that all areas are located at a uniform distance from the shaft, and a not-yet-rolled developing roller 509 is formed (S004).

Regarding the cylindrical member 515 whose surface has been polished, two types of the groove portions 511*a* and 511*b* are formed on the surface thereof by rolling with an apparatus which has dies 900 as two types of tools as shown in FIG. 8 (S005). A rolling apparatus arranges a workpiece (in this example, the not-yet-rolled developing roller 509) while the two types of dies 900 arranged opposite each other are rotating in a same direction. The rolling apparatus causes the two types of dies 900 to press the not-yet-rolled developing roller 509, and carries the not-yet-rolled developing roller 509 in the axial direction, with rotating it in a direction opposite to the rotation of the dies 900. The dies 900 are furnished with edges 900*a* for forming the above-mentioned groove portions 511*a* and 511*b* respectively, and the edge 900*a* of each dies is inclined such that the groove portions 511*a* and 511*b*, which are formed with the edge of each dies on a surface of the not-yet-rolled developing roller 509, are perpendicular to each other. Though a section at which the dies 900 abut against the surface of the not-yet-rolled developing roller 509 is defined as the edge 900*a*, in rolling, the section does not work to actively cut a workpiece, but rather it works so as to press and crush a workpiece with pressure and to form a recess. Further, when the rolling is performed, a surface of both of the end sections 510*b* of the not-yet-rolled developing roller 509 remains smooth without recesses and projections, by causing the dies 900 not to abut against both of the end sections 510*b*. In other words, the top surface 512*a* of the projection portion 512 which the dies 900 do not contact in the central section 510*a* is located at a uniform distance L from the shaft center C as both of the end sections 510*b* which is not to be rolled. A surface 510*d* of the developing roller 510 is covered almost entirely with unprocessed surfaces which the dies 900 do not contact and with the bottom surfaces 511*c* of the groove portions 511*a* and 511*b* which are provided in a depressed condition by contacting of the dies 900.

It is possible to provide, on the developing roller 510 formed by rolling, electroless Ni—P plating, electroplating, hard chrome plating, and the like, as necessary.

Regarding the developing roller 510, toner is supplied by the toner supply roller 550 to the section between the end-section seals 527 which abut at both of the end sections 510*b* respectively, and the layer thickness of a toner layer is restricted at a pressing position of the restriction blade 560. At this time, the restriction blade 560 is pressed all along the end sections 510*b* and the central section 510*a* of the developing roller 510. The restriction blade 560 presses the developing roller 510 in a substantially flat state without bending greatly because both of the end sections 510*b* of the developing roller 510 and the top surfaces 512*a* of the projection portions 512 are located at a uniform distance L from the shaft center C. Therefore, the restriction blade 560, which abuts against the developing roller 510 all along the central section 510*a* and both of the end sections 510*b*, does not bend greatly in the axial direction and does abut in a substantially flat state, for example. In other words, the restriction blade 560 does not bend greatly, so that it becomes possible to eliminate the occurrence of an extremely large opening between the developing roller 510 and the restriction blade 60.

Besides, regarding the projection portion 512 of the surface 510*d* of the developing roller 510, the top surface 512*a* of each projection portion 512 is located on a circumferential surface formed having a single radius from the developing roller 510 because the top surfaces 512*a* thereof which are arranged with sandwiching the groove portions 511, serving as a recess, are located at a uniform distance L from the shaft center C. Therefore, when, for example, a flat surface of the restriction blade 560 is pressed towards the developing roller 510 in order to restrict the layer thickness of the borne toner particles T, toner particles borne on the top surface 512*a* by each of the projection portions 512 are pressed in the same way. This enables to make the layer thickness of toner particles T borne by the developing roller 510 almost even throughout the developing roller 510. Especially, a substantially even amount of toner particles T enters the groove portions 511 throughout the entire area thereof because a distance from the top surface 512*a* of the projection portion 512 to the bottom surface 511*c* of the groove portion 511 is uniform, the projection portion 512 and the groove portion 511 being located on the central section 510*a* of the developing roller 510 having recesses and projections. This enables to make the amount of toner particles T borne by the developing roller 510 almost even throughout the developing roller 510.

In addition, the layer thickness of a toner layer formed by toner particles having entered between the developing roller 510 and the restriction blade 560 can be kept from exceeding two toner particles because the distance from the top surface 512*a* of the projection portion 512 to the bottom surface 511*c* of the groove portion 511 is not more than twice as much as the volume-weighted average diameter. In other words, a large amount of toner particles does not enter the groove portions 511, and most of the toner particles contact either of the surface 510*d* of the developing roller 510 and a surface of the restriction blade 560 when being pressed by the restriction blade 560. Accordingly, each of the toner particles T is likely to be rolled by being pressed in the same manner and the toner particles are resistant to remain in the groove portions 511, so that it is possible to charge toner particles T evenly and satisfactorily. This enables to prevent toner particles T from spilling outside the developing sections 51, 52, 53, 54 because toner particles are certainly borne by the developing roller 510 and are used for development and because an extremely large opening does not occur between the surface 510*d* of the developing roller 510 and the restriction blade 560.

Figure 10:
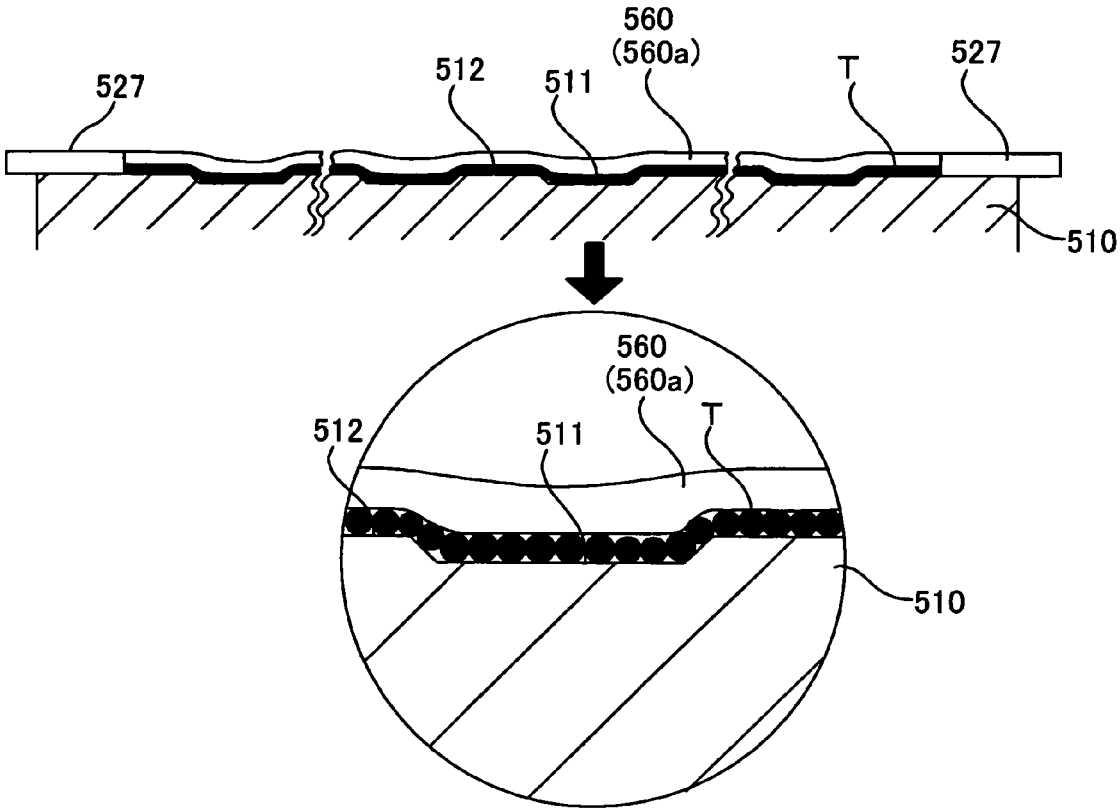
FIG. 10 is a diagram for describing a state in which a restriction blade abuts against the developing roller bearing toner particles.

FIG. 10 is a diagram for describing a state in which the restriction blade abuts against the developing roller bearing toner particles.

Especially, the groove portion 511 of the developing roller 510 in the present embodiment is 7 μm deep and is approximately once as large as the volume-weighted average diameter of toner particles T. This enables to form, throughout the surface of the developing roller 510, a toner layer having thickness corresponding to one toner particle without toner particles T overlapping because the restriction blade 560 is made of rubber and is positioned along recesses and projections which are formed on the surface 510*d* of the developing roller 510. By forming a one-particle-thick toner layer on the surface 510*d* of the developing roller 510 in the above-mentioned way, it is possible to certainly charge each of the toner particles T throughout the central section 510*a* including the projection portions 512 and the groove portions 511 thereof, and it is also possible to improve capability for the toner particles to be transferred in development by ensuring bearing of the developing roller 510, and in addition to prevent toner from spilling outside the developing sections.

In other words, if recesses and projections which are not uniform in size, depth, shape, etc. are formed on the surface 510*d* of the developing roller 510, the toner particles which are borne and have entered a deep recess are resistant to rolling and to being charged. Further, if the groove portions are formed in the circumferential direction at a predetermined spacing in the axial direction, density of the developed toner image may become higher only in an area which is positioned opposite the groove portion. The reason is because a section of the photoconductor 20 which is located opposite the groove portion does not change in position with respect to the axial direction regardless of rotation of the photoconductor 20. On the other hand, if the groove portions are formed in the axial direction, the borne toner particles are resistant to rolling and to being charged because the rotating direction of the toner-particle bearing roller is substantially perpendicular to the direction of the groove portions.

With the developing sections 51, 52, 53, 54 and the developing roller 510 of the present embodiment, it is possible to charge toner particles T satisfactorily by making the toner particles T roll and move with the rotation of the developing roller 510. The reason is because the helical groove portions 511 are formed on the surface 510*d* of the developing roller 510 at a uniform pitch in the axial direction, and because the groove portions 511 are inclined with respect to the axial direction and the circumferential direction. In addition, it is possible to reduce the occurrence of unevenness in density on the developed toner image because a position where the photoconductor 20 and the groove portions 511 are located opposite each other successively changes in the axial direction and in the circumferential direction, with the rotation of the developing roller 510.

Further, toner particles T are moved towards two directions along the groove portions 511*a* and 511*b* because two types of the groove portions 511*a* and 511*b* whose inclinations are different are formed on the developing roller 510 of the present embodiment. This enables to prevent toner particles T from moving to only one predetermined direction and from being distributed unevenly. It is also possible that, if a toner particle T has once started rolling along one type of the groove portion 511*a* (511*b*), the toner particle T shifts direction and starts rolling along the other type of the groove portion 511*b* (511*a*) because the two types of the groove portions 511*a* and 511*b* intersect to form lattices. This enables to suppress more effectively uneven movement of toner particles T in terms of direction.

Further, the top surface 512*a* of the projection portion 512 surrounded by two types of the groove portions 511 has a square shape. Either of diagonal lines in the square is in the circumferential direction. Therefore, two vertex angles located in the circumferential direction and two vertex angles located in the axial direction of the projection portion 512 all are a right angle, and two types of the groove portions 511*a* and 511*b* have an inclination of the same angle with respect to the circumferential direction and the axial direction. Accordingly, it is possible to achieve a configuration in which toner particles T are likely to move in the same way towards the circumferential direction and the axial direction. This enables to charge toner particles evenly by making them roll more evenly.

Furthermore, toner particles T borne by the surface of the developing roller 510, especially the projection portion 512, are not scraped off completely by the restriction blade 560 because the layer thicknesses of toner particles T borne on the surface of the developing roller 510 is restricted by the flat surface of the rubber section 560*a* included in the restriction blade 560. In other words, it is possible to restrict the layer thickness of toner particles T with causing the groove portions 511 and the projection portions 512 of the developing roller 510 to bear toner particles T. Further, toner particles T are rubbed against any of the restriction blade 560 and the surface of the developing roller 510, or toner particles T are rubbed against each other, so that the toner particles T can be charged satisfactorily. The reason is because the toner particles T borne by the surface 510*d* are pressed by the flat surface included in the restriction blade 560.

As mentioned above, using laser beam, a laser beam printer forms a latent image on the photoconductor 20, and the formed latent image is developed using toner borne by the developing roller 510. In this case, on the photoconductor 20, by switching on and off the laser beam which scans in a main scanning direction (the axial direction), dot-like latent images are formed in the regions divided into lattice cells, that is, in a so-called screen. A latent image consists of these dot-like latent images.

Besides, in case of the developing roller 510 having the obviously distinguished groove portions (recesses) 511 and projection portions 512 as described in the present embodiment, there are cases in which a larger number of toner particles T enter the groove portions 511 than the projection portions 512, for example. In this case, in a toner image, density may differ between an area developed by the groove portion 511 and an area developed by the projection portion 512. Especially, an image which does not occupy a wide area, such as characters and line arts, is not affected greatly, but in an image which occupies a wide area, such as photographs and illustrations, unevenness in density may become conspicuous. This phenomenon becomes more likely to occur if the pitch in the axial direction of the groove portions 511 formed on the developing roller 510 is larger than the pitch of lattices in the above-mentioned main scanning direction of the screen. The reason is because, even among dots to be formed originally in the same density, density differs depending on whether the dot is developed by the groove portion 511 of the developing roller 510 or by the projection portion 512 of the developing roller 510.

Therefore, in the developing roller 510 in the present embodiment, the pitch of the groove portion 511 in the axial direction, formed on the developing roller 510, is shorter than the longest pitch of lattices which is used in formation of an image which occupies some area such as photographs and illustrations. In this case, when an image which occupies a wide area, such as photographs and illustrations, is formed, the pitch of the lattices in the main scanning direction of a latent image is not the dot pitch in an image having maximum resolution at which the laser beam printer can form an image. The reason thereof is that, when a laser beam printer forms an image which occupies a wide area, such as photographs and illustrations, dots are formed at lower resolution than the maximum resolution of a printer and each dot is caused to have multiple tone levels in order to improve entire image quality.

Figure 11:
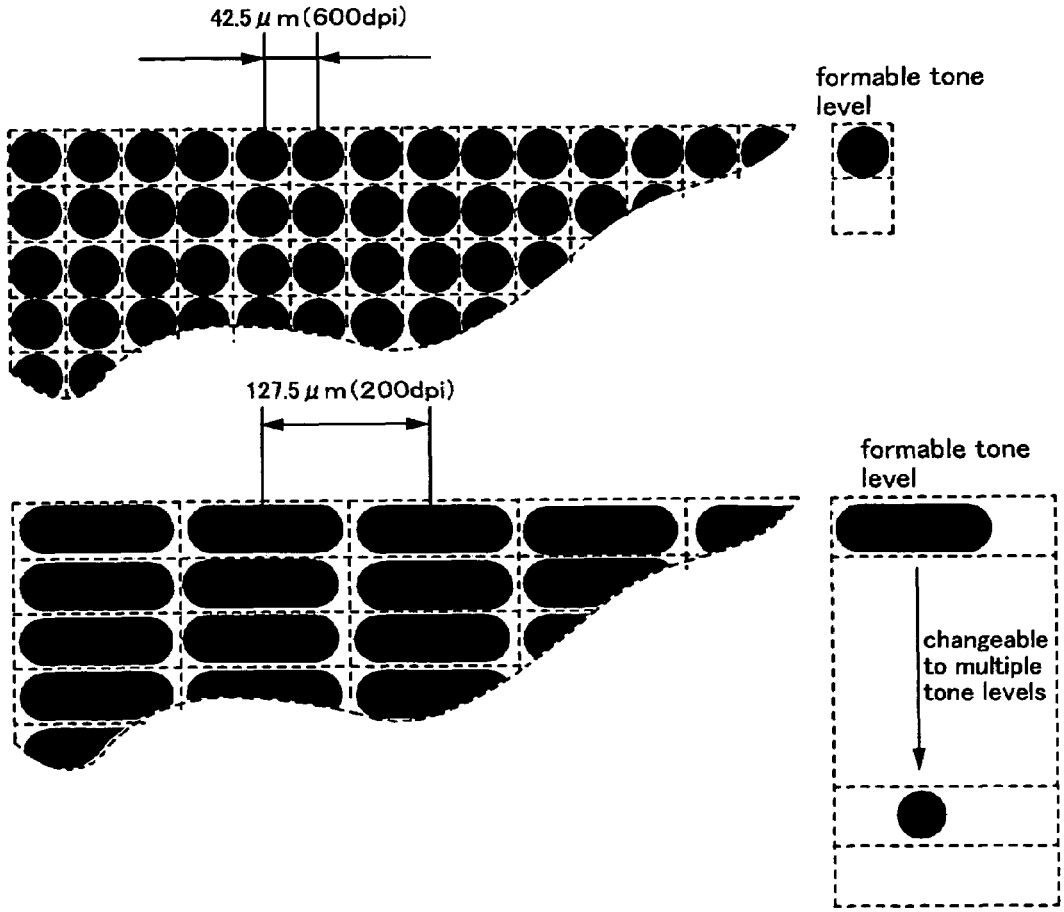
FIG. 11 is a diagram for describing resolution on a screen and in a latent image.

FIG. 11 is a diagram for describing the pitch on a screen and in a latent image. As shown in the diagram, for example, in the event that the maximum resolution of the printer is 600 dpi (pitch 42.5 μm), if resolution of a latent image is 600 dpi, a region in which a dot-like latent image can be formed is divided into lattice cells having 42.5 μm pitch. Accordingly, in each of the divided regions, tone levels are represented only by the presence or absence of a dot-like latent image (the upper diagram in FIG. 11).

Therefore, when forming an image which occupies a wide area, tone levels are expressed, for example, by: treating three dot-like latent images at resolution of 600 dpi as one dot-like latent image; and changing the length of time that the semiconductor laser emits the laser beam within a period of time during which the semiconductor laser can respond for three dot-like latent images at resolution of 600 dpi (the lower diagram in FIG. 11). In this case, resolution in formation of an image which occupies a wide area becomes 200 dpi, and a region in which a dot-like latent image can be formed will be divided into lattice cells having a 127.5 μm pitch. Consequently, in the developing roller 510 of the present embodiment, by setting the pitch of the groove portions 511 to 80 μm in the axial direction, all dot-like latent images included in a latent image having 200 dpi, that is, a latent image formed in a region that is divided into lattice cells at a 127.5 μm pitch are developed by a section of the developing roller 510, the section including the groove portions 511 and the projection portions 512. This reduces the occurrence of unevenness in density in the developed toner image. The present embodiment describes an example in which the maximum resolution of a laser beam printer is 600 dpi, the pitch of the regions divided into lattice cells, where dot-like latent image can be formed in formation of an image such as photographs, is 127.5 μm in the axial direction, and the pitch of the groove portions 511 of the developing roller 510 is 80 μm in the axial direction. However, this invention is not limited thereto, and so other configurations are acceptable as long as the pitch, in the axial direction, of the groove portions 511 of the developing roller 510 is smaller than the pitch, in an axial direction, of regions that are divided into lattice cells and in which the dot-like latent images are formed in a latent image in formation of an image such as photographs. Further, especially, if the maximum distance, in the axial direction, between the groove portion 511 and the projection portion 512 adjacent one another is shorter than the region which is divided into lattice cells and in which a dot-like latent image can be formed, it is possible to effectively reduce the occurrence of unevenness in density in an image which occupies a wide area because one dot-like latent image is developed, at least, by one of the groove portions 511 and one of the projection portions 512. For example, if a maximum width of the groove portion 511 is 40 μm in the axial direction and a maximum width of the projection portion 512 is 40 μm in the axial direction, it is possible to effectively reduce the occurrence of unevenness in density in an image which occupies a wide area because one of the groove portions 511 and one of the projection portions 512 both are included in a region which is divided into lattice cells having a 127.5 μm pitch and in which a dot-like latent image can be formed.

Figure 12:
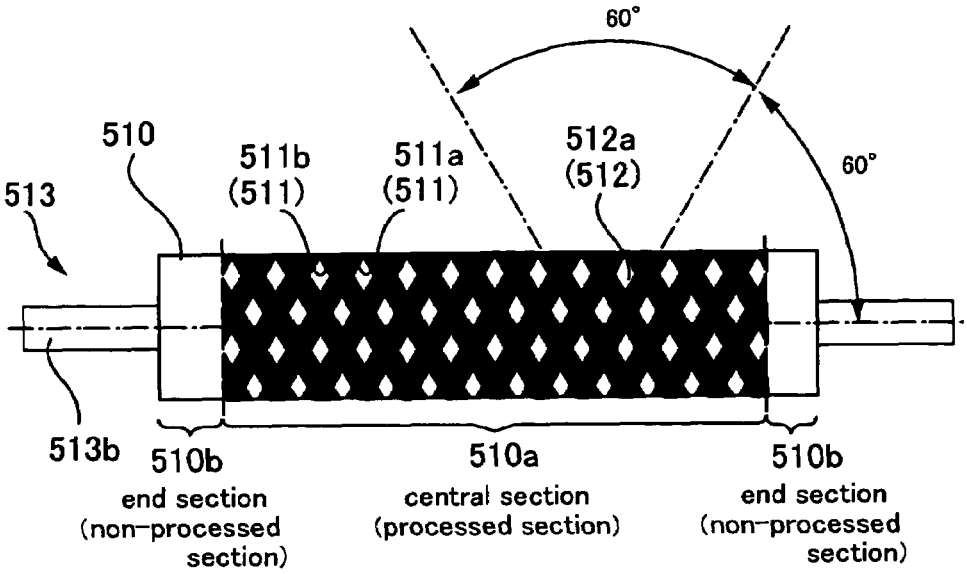
FIG. 12 is a diagram showing the first modified example of a developing roller.
Figure 13:
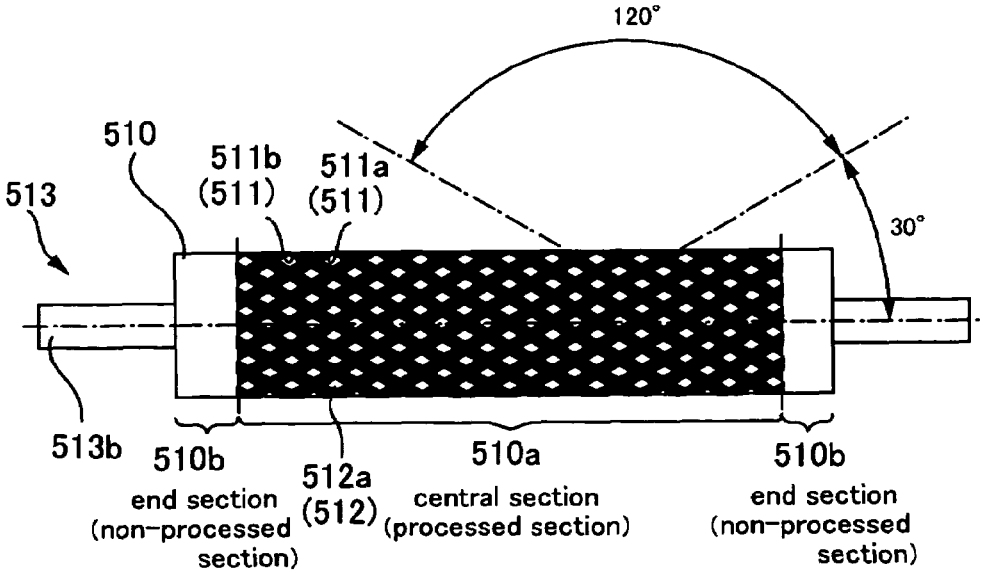
FIG. 13 is a diagram showing the second modified example of the developing roller.
Figure 14:
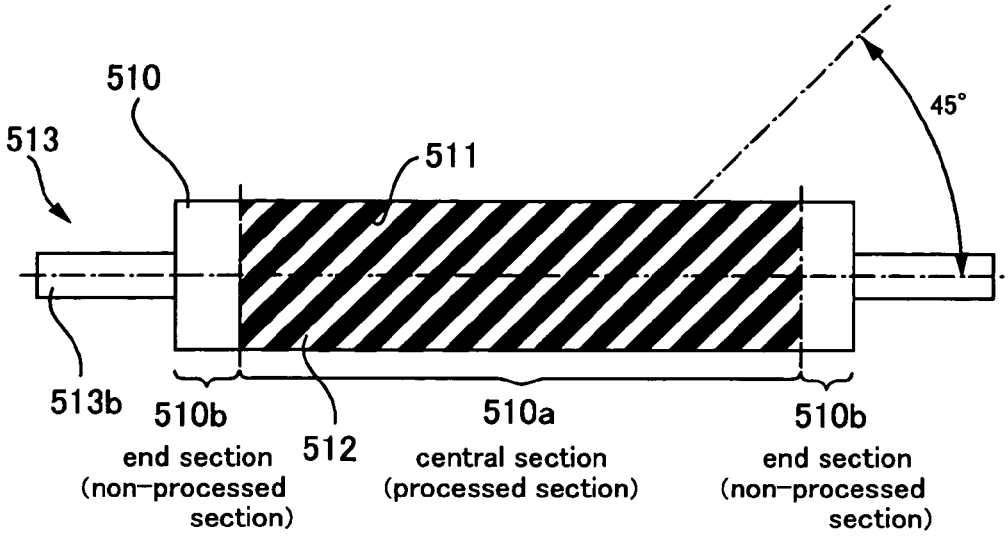
FIG. 14 is a diagram showing the third modified example of the developing roller.

In the present embodiment, an example is described in which the top surface 512*a* of the projection portion 512 surrounded by two types of groove portions 511*a* and 511*b* has a square shape, but this invention is not limited thereto. FIG. 12 is a diagram showing the first modified example of the developing roller. FIG. 13 is a diagram showing the second modified example of the developing roller. FIG. 14 is a diagram showing the third modified example of the developing roller.

In the developing roller 510 of the first modified example, the top surface 512*a* of the projection portion 512 surrounded by two types of the groove portions 511 is rhombus, and the groove portions are formed such that either of two diagonal lines in each of the rhombuses is along the circumferential direction. In the developing roller 510 of the first modified example, a recess is formed by rolling as mentioned above. Therefore, the top surfaces 512*a* of the projection portion 512 are located at a uniform distance from the shaft center C, the top surfaces 512*a* being arranged in the central section 510*a* of the developing roller 510 with sandwiching recesses and not having been contacted by the die 900. Also, the top surface 512*a* of the projection portion 512 and both of the end sections 510*b* that are not targeted for the rolling processing are located at a uniform distance from the shaft center C, the top surface 512*a* being in the central section 510*a* and not having been contacted by the die 900.

With the above-mentioned developing roller 510, the groove portions 511 are formed such that either one of the two diagonal lines in each of the rhombuses is along the circumferential direction. Thus, from each vertex angle on the diagonal line which is along the circumferential direction, two types of the groove portions 511 are respectively formed towards both ends in the axial direction at an inclination of the same angle. Accordingly, in the same way as the case in which the top surface 512*a* of the projection portion 512 is square, toner particles T which are moved along the two types of the groove portions 511 can be moved towards both ends in the axial direction almost evenly and the toner particles can be moved evenly. In addition thereto, if, among two diagonal lines of the projection portion 512 whose top surface 512*a* is rhombus, a longer diagonal line is along the circumferential direction, then the two vertex angles located in the circumferential direction, of the projection portion 512 whose top surface 512*a* is rhombus, are acute angles, and the two vertex angles located in the axial direction are obtuse angles. This enables a configuration in which toner particles are more likely to move towards the circumferential direction.

Further, as shown in FIG. 13, if a shorter diagonal line, among the two diagonal lines of the projection portion 512 whose top surface 512*a* is rhombus, is along the circumferential direction, then the two vertex angles located in the circumferential direction, of the projection portion whose top surface is rhombus, are obtuse angles, and the two vertex angles located in the axial direction are acute angles. In the developing roller 510 according to the second modified example, a recess is formed by rolling as mentioned above. Therefore, the top surfaces 512*a* of the projection portion 512 are located at a uniform distance from the shaft center C, the top surfaces 512*a* being arranged in the central section 510*a* of the developing roller 510 with sandwiching recesses and not having been contacted by the die 900. Also, the top surface 512*a* of the projection portion 512 and both of the end sections 510*b* that are not targeted for the rolling processing are located at a uniform distance from the shaft center C, the top surface 512*a* being in the central section 510*a* and not having been contacted by the die 900.

This enables a configuration in which toner particles are more likely to move towards the axial direction and toner is more greatly distributed throughout the developing roller 510.

In the present embodiment, an example is described in which two types of the groove portions 511*a* and 511*b* are provided on the surface of the developing roller 510, but the groove portions 511 can be one type, as in the third modified example shown in FIG. 14. In the developing roller 510 of the third modified example, a recess is formed by rolling as mentioned above. Therefore, the surfaces of the projection portion 512 are located at a uniform distance from the shaft center C, the surfaces being arranged in the central section 510*a* of the developing roller 510 with sandwiching recesses and not having been contacted by the die 900. Also, the surface of the projection portion 512 and both of the end sections 510*b* that are not targeted for the rolling processing are located at a uniform distance from the shaft center C, the surface being in the central section 510*a* and not having been contacted by the die 900.

In this case, there is an effect of charging toner particles T by making them roll in a predetermined direction. However, the developing roller 510 in the above-mentioned embodiment which includes two types of groove portions 511*a* and 511*b* achieves more advantageous effects as a configuration in which toner particles are charged more satisfactorily and toner particles are distributed more greatly throughout the developing roller 510.

Other Embodiments (Second Embodiment through Fourth Embodiment, etc.)

In the foregoing, a developing device etc. according to the present invention was described according to the above-mentioned embodiments thereof. However, the above-mentioned embodiment of the invention is for the purpose of facilitating understanding of the present invention and not to be interpreted as limiting the present invention. The present invention can be altered and improved without departing from the gist thereof, and needless to say, the present invention includes its equivalents.

In the above-mentioned embodiment, a full-color laser beam printer was described as an example of an image forming apparatus. However, the present invention is also applicable to various other types of image forming apparatuses such as monochrome laser beam printers, copying machines, and facsimiles.

In addition, in the above-mentioned embodiment, an example in which a printer has a plurality of attach/detach sections is described, but a configuration having a lid unit which can be closed by inserting a to-be-attached developing section into a single attach/detach section is also acceptable. Besides, the above-mentioned embodiment is described with an example of an image forming apparatus including developing devices in a rotary arrangement, but this invention is not limited thereto. For example, the present invention is also applicable to an image forming apparatus including developing devices in a tandem arrangement.

Further, a photoconductor is not limited to a so-called photoconductive roller structured by providing a photoconductive layer on the outer peripheral surface of a cylindrical conductive base. It also can be a so-called photoconductive belt structured by providing a photoconductive layer on the surface of a belt-like conductive base.

Furthermore, the following second embodiment through the fourth embodiment can be given as other preferable embodiments.

The Second Embodiment

Figure 15:
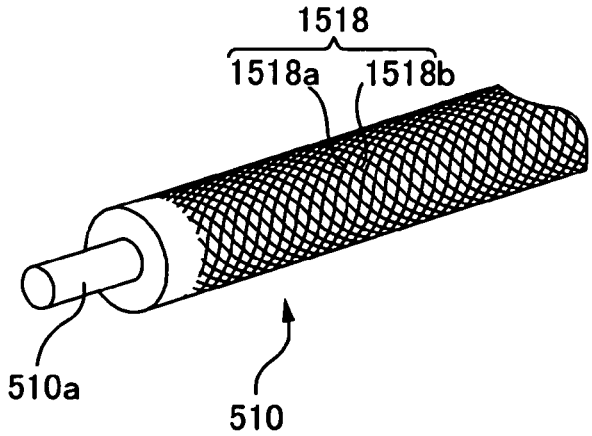
FIG. 15 is a perspective view of a schematic diagram showing a developing roller of a developing section according to the second embodiment.
Figure 16:
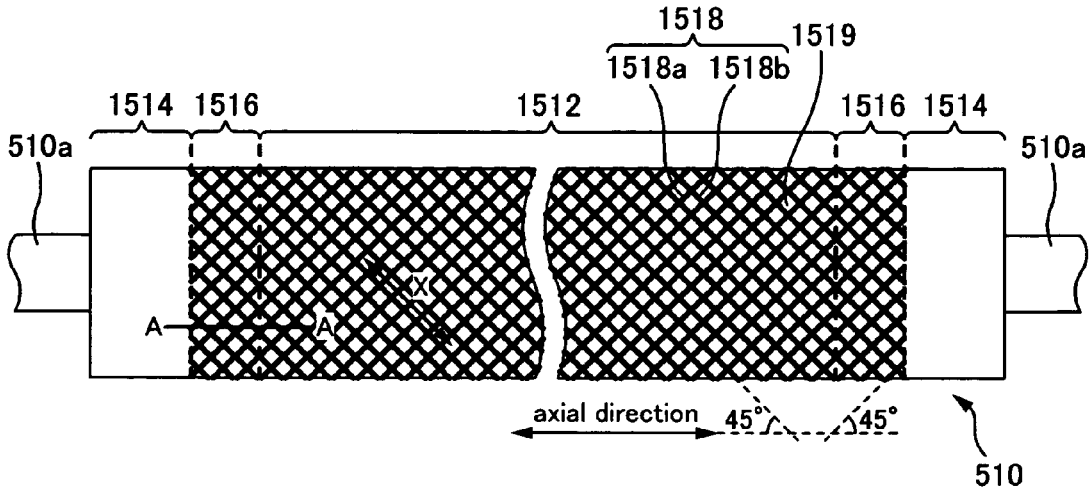
FIG. 16 is a front view of a schematic diagram showing the developing roller of the developing section according to the second embodiment.
Figure 17:
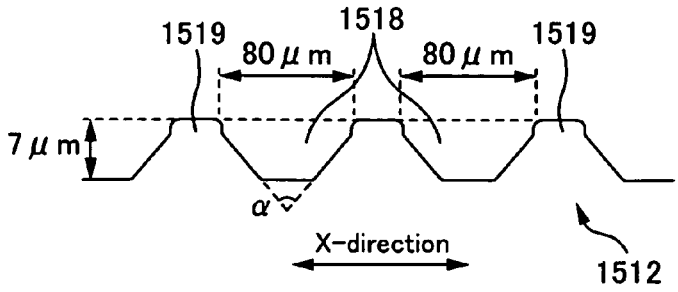
FIG. 17 is a schematic diagram showing a cross-sectional shape of grooves according to the second embodiment.
Figure 18:
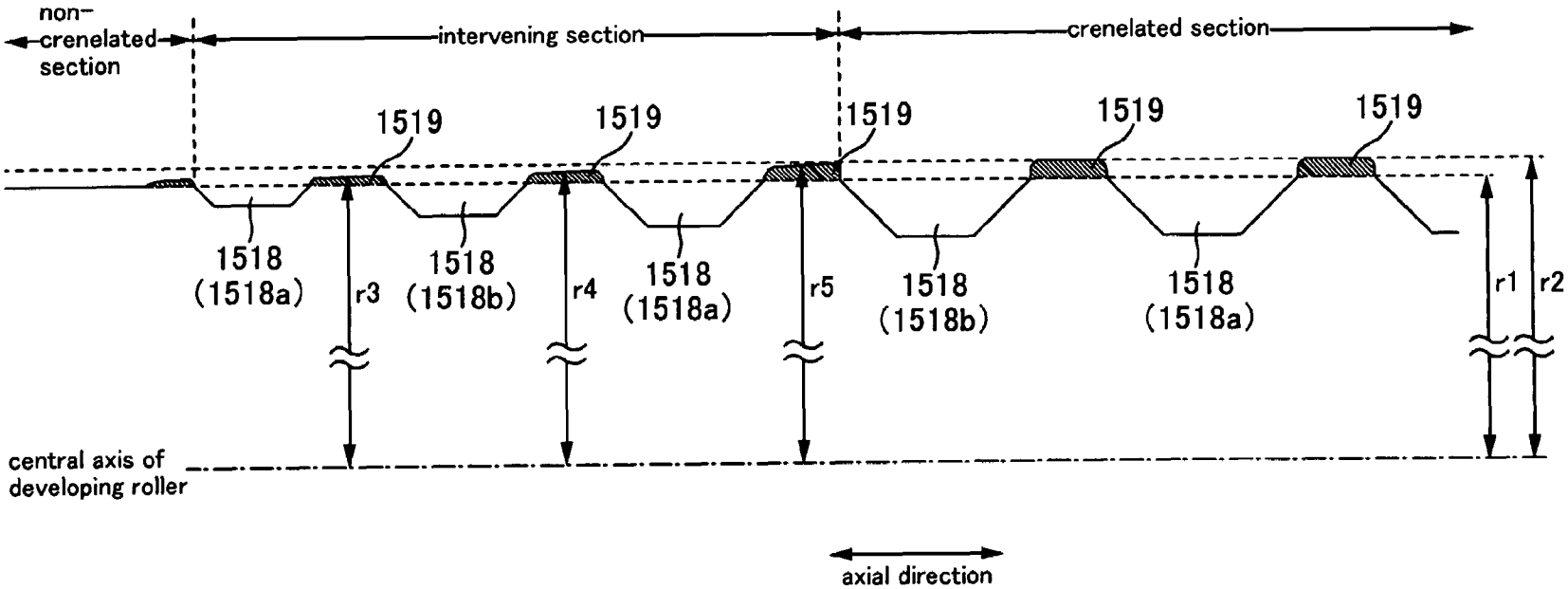
FIG. 18 is a schematic diagram showing a cross-section of FIG. 16 taken along line A-A.

Configuration Example of Developing Roller 510 of Developing Section According to the Second Embodiment Here, a configuration example of the developing roller 510 of the developing section according to the second embodiment is described with reference to FIGS. 15 through 18. FIG. 15 is a perspective view of a schematic diagram of the developing roller 510, and is a diagram showing a helical first groove 1518*a* and a helical second groove 1518*b* which are different from each other in their respective twisting direction. FIG. 16 is a front view of a schematic diagram of the developing roller 510, and is a diagram showing the positional relationship between an indentation-processed section 1512, a non-indentation-processed section 1514, and an intervening section 1516 of the developing roller 510. FIG. 17 is a schematic diagram showing a cross-sectional shape of grooves 1518. FIG. 18 is a schematic diagram showing a cross-section of FIG. 16 taken along line A-A, and is a diagram showing the difference between the depth of the groove 1518 of the indentation-processed section 1512 and the depth of the groove 1518 of the intervening section 1516. Note that, in FIGS. 15 through 18, the scale on which the grooves 1518 and the like are illustrated is different from the actual scale for the purpose of facilitating the understanding of the drawings. In addition, FIG. 17 shows a cross-section taken along a direction indicated by symbol X in FIG. 16.

The developing roller 510 of the developing section according to the second embodiment bears toner T and carries it to the developing position opposite the photoconductor 20. The developing roller 510 is a member made of aluminum alloy, iron alloy and the like. As shown in FIGS. 16, 18, etc., the developing roller 510 is separated into three main sections (the indentation-processed section 1512, the non-indentation-processed section 1514, and the intervening section 1516) according to the difference of surface structure.

The indentation-processed section 1512 is a section located on the central section in the axial direction of the developing roller 510, and the surface thereof is subjected to an indentation process in order to appropriately bear toner T (projections and recesses of the indentation-processed section 1512 both serve as a toner bearing section for bearing toner). In the present embodiment, the above-mentioned rolling process is used as the above-mentioned indentation process, and the recesses and projections are formed by subjecting the surface of the indentation-processed section 1512 to the above-mentioned rolling process. More specifically, the grooves 1518 are formed in the surface of the indentation-processed section 1512 by the rolling process, and therefore, the indentation-processed section 1512 has the grooves 1518 as recesses and non-groove portions 1519 as projections.

In the present embodiment, the helical first groove 1518*a* and the helical second groove 1518*b* whose twisting directions are different from one another are provided as the grooves 1518, as shown in FIGS. 15 and 16. An acute angle between a longitudinal direction of the first groove 1518*a* and the axial direction, and an acute angle between a longitudinal direction of the second groove 1518*b* and the axial direction both are approximately 45°. Besides, as shown in FIG. 17, the width and depth of the groove 1518 are approximately 80 μm and approximately 7 μm respectively, and a groove angle (an angle indicated by symbol α in FIG. 17) is approximately 90°. Note that, in the present embodiment, since toner T is particulate (a particle) and the volume-weighted average diameter of toner T is approximately 7 μm, the depth of the groove 1518 is substantially the same as the volume-weighted average diameter of toner T.

Further, electroless Ni—P plating is provided on the surface of the indentation-processed section 1512.

The non-indentation-processed section 1514 is a section whose surface is not subjected to the above-mentioned indentation process (rolling process). The non-indentation-processed section 1514 is located on both of the end sections in the axial direction of the developing roller 510, and its surface is smooth (the ten-point average height of irregularities Rz of the surface is 1 μm or less). Note that electroless Ni—P plating is not provided on the surface of the non-indentation-processed section 1514 unlike the indentation-processed section 1512.

The intervening section 1516 is a section located between the indentation-processed section 1512 and the non-indentation-processed section 1514 in the axial direction of the developing roller 510, and the surface construction thereof differs from those of the indentation-processed section 1512 and the non-indentation-processed section 1514.

In other words, though the helical grooves 1518 (the first groove 1518*a* and the second groove 1518*b* ) are formed on a surface of the intervening section 1516 by rolling in the same manner as the indentation-processed section 1512, as shown in FIG. 16, the depth of the groove 1518 is different from the depth of the groove 1518 of the indentation-processed section 1512, as shown in FIG. 18. Further, electroless Ni—P plating is not provided on the surface thereof unlike the indentation-processed section 1512.

A difference relating to the depth of grooves is described more specifically. As can be seen from FIG. 18, regarding all of the grooves 1518 formed on the surface of the intervening section 1516, the depth thereof is less than the depth of the groove 1518 formed on the surface of the indentation-processed section 1512 (FIG. 18 shows only three grooves 1518 as the grooves 1518 provided in the intervening section 1516 for the sake of convenience, but a greater number of the grooves 1518 than those mentioned above are actually provided in the intervening section 1516). Besides, the depth of the groove 1518 formed on the surface of the intervening section 1516 is large if that groove 1518 is located on the side of the indentation-processed section 1512 of the intervening section 1516, and is small if that groove 1518 is located on the side of the non-indentation-processed section 1514. Further, the depth of the groove 1518 becomes smaller as the groove 1518 is closer to the non-indentation-processed section 1514 (in other words, becomes larger as the groove 1518 is closer to the indentation-processed section 512).

In this section, radii of the indentation-processed section 1512, of the non-indentation-processed section 1514, and of the intervening section 1516 are considered. As mentioned above, in the present embodiment, since the grooves 1518 are formed by rolling (not by machining), the non-groove portion 1519 is made to rise up as a result of performing the rolling process (protruding portions that are made to rise up as a result of the rolling process are shaded in FIG. 18). Accordingly, radius r2 (in the non-groove portion 1519) of the indentation-processed section 1512 and radii r3, r4, r5 (in the non-groove portion 1519) of the intervening section 1516 are larger than radius r1 of the non-indentation-processed section 1514. Besides, as the depth of the groove 1518 becomes gradually larger, the protruding condition of the protruding portions becomes gradually larger. Accordingly, the radius r2 (in the non-groove portion 1519) of the indentation-processed section 1512 is larger than the radii r3, r4, r5 (in the non-groove portion 1519) of the intervening section 1516.

In other words, the radii of the intervening section 1516 are less than the maximum radius of the indentation-processed section 1512 (that is, a radius in the non-groove portion 1519), and are more than the radius of the non-indentation-processed section 1514.

Further, as mentioned above, the depth of the groove 1518 formed on the surface of the intervening section 1516 is large if that groove 1518 is located on the side of the indentation-processed section 1512 of the intervening section 1516, and is small if that groove 1518 is located on the side of the non-indentation-processed section 1514. Further, the depth of the groove 1518 becomes smaller as the groove 1518 is closer to the non-indentation-processed section 1514. Accordingly, the radius of the intervening section 1516 is large on the side of the indentation-processed section 1512 of the intervening section 1516 (radius r5), and is small on the side of the non-indentation-processed section 1514 of the intervening section 1516 (radius r3). In addition, the radii of the intervening section 1516 becomes gradually smaller from the side of the indentation-processed section 1512 to the side of the non-indentation-processed section 1514 (radius r5>radius r4>radius r3).

Note that, as mentioned above, in the developing roller 510 according to the present embodiment, the depth of the groove 1518 is different between the indentation-processed section 1512 and the intervening section 1516, and the depth of the groove 1518 can be made to differ by changing the pressing force which causes a die to press a not-yet-rolled developing roller when the above-mentioned rolling is performed (i.e., making the pressing force weaker in order to make the depth of the groove 1518 small, and making the pressing force stronger in order to make the depth of the groove 1518 large).

Regarding Effectiveness of Developing Sections According to the Second Embodiment As mentioned above, the developing section according to the present embodiment includes the developing roller 510 that is for bearing toner and that includes the indentation-processed section 1512 that is located on a central section in the axial direction of the developing roller 510 and whose surface is subject to an indentation process in order to bear toner, the non-indentation-processed section 1514 that is located on both end sections in the axial direction of the developing roller 510 and whose surface is not subject to the indentation process, and the intervening section 1516 that is located between the indentation-processed section 1512 and the non-indentation-processed section 1514 in the axial direction of the developing roller 510 and whose radius is less than the maximum radius of the indentation-processed section 1512 and is more than the radius of the non-indentation-processed section 1514; and the developing section further includes the restriction blade 560 that is for restricting the layer thickness of toner borne by the developing roller 510 by abutting against the developing roller 510 contiguously from one of the end sections in the axial direction of the developing roller 510 to the other of the end sections. This enables to achieve a developing device and the like which appropriately restricts the layer thickness of toner borne by the developing roller 510.

In other words, the central section in the axial direction of the developing roller 510 is furnished with the indentation-processed section 1512, and both of the end sections in the axial direction are furnished with the non-indentation-processed section 1514. However, the restriction blade 560 abuts against the developing roller 510 contiguously from one of the end sections in the axial direction of the developing roller 510 to the other of the end sections, so that a large step between the indentation-processed section 1512 and the non-indentation-processed section 1514 causes the restriction blade 560 to abut against the developing roller 510 inappropriately. As a result thereof, the above-mentioned function of the restriction blade 560, that is, function of restricting the layer thickness of toner borne by the developing roller 510 does not work appropriately.

In contrast, the developing device according to the present embodiment is furnished with the intervening section 1516 which is located between the indentation-processed section 1512 and the non-indentation-processed section 1514 in the axial direction of the developing roller 510, and whose radius is less than the maximum radius of the indentation-processed section 1512 and is more than the radius of the non-indentation-processed section 1514. Therefore, there is no large step between the indentation-processed section 1512 and the non-indentation-processed section 1514, so that the restriction blade 560 abuts against the developing roller 510 appropriately. Accordingly, the restriction blade 560 appropriately restricts the layer thickness of toner borne by the developing roller 510.

Other Embodiments According to the Second Embodiment

In the above-mentioned embodiment, the radius of the intervening section 1516 is large on the side closer to the indentation-processed section 1512 of the intervening section 1516 (radius r5), and is small on the side closer to the non-indentation-processed section 1514 of the intervening section 1516 (radius r3). However, this invention is not limited thereto. For example, in FIG. 18, radius r3, radius r4, and radius r5 may be the same in length (the relationship with radius r1 and radius r2 is radius r1<radius r3=radius r4=radius r5<radius r2).

However, the above-mentioned embodiment is more desirable in allowing the restriction blade 560 to abut against the developing roller 510 more properly so that the layer thickness of toner borne by the developing roller 510 is restricted more appropriately by the restriction blade 560.

Besides, in the above-mentioned embodiment, the radius of the intervening section 1516 becomes gradually smaller from the side of the indentation-processed section 1512 to the side of the non-indentation-processed section 1514 of the intervening section 1516 (radius r5>radius r4>radius r3), but this invention is not limited thereto. For example, in FIG. 18, radius r3 can be the same in length as radius r4 (the relationship with radius r1 and radius r2 is radius r1<radius r3=radius r4<radius r5<radius r2).

However, the above-mentioned embodiment is more desirable in allowing the restriction blade 560 to abut against the developing roller 510 more properly so that the layer thickness of toner borne by the developing roller 510 is restricted more appropriately by the restriction blade 560.

Besides, in the above-mentioned embodiment, the end-section seal 527 is provided which is for preventing toner spillage by contacting the non-indentation-processed section 1514 along the circumferential surface of the developing roller 510, and the surface of the intervening section 1516 is not plated while the surface of the indentation-processed section 1512 is plated. However, this invention is not limited thereto. For example, the surface of the indentation-processed section 1512 and the surface of the intervening section 1516 may both be plated.

Plating the surface of the developing roller 510 improves the capability of the toner of being charged due to improvement of the capability of the toner to roll. However, if the surface of the intervening section 1516, as well as the surface of the indentation-processed section 1512, is plated, toner becomes, due to the above-mentioned improvement of capability to roll, more likely to move to the non-indentation-processed section 1514 which is contacted by the end-section seal 527 which is for preventing toner spillage (in other words, necessary to obstruct toner).

In the above-mentioned embodiment, by improving the capability of the toner of being charged and by suppressing movement of toner towards the non-indentation-processed section 1514, it is possible to appropriately prevent toner spillage because, among the surfaces of the indentation-processed section 1512 and the intervening section 1516, only the former is plated and the latter is not plated. Considering this point, the above-mentioned embodiment is more desirable.

Further, in the above-mentioned embodiment, the groove 1518 whose depth is less than the depth of the groove 1518 formed on the central section in the axial direction is formed using rolling on the intervening section 1516 which is located between each of both end sections in the axial direction and the central section in the axial direction of the developing roller 510. This enables to achieve the intervening section 1516 whose radius is less than the maximum radius of the indentation-processed section 1512 and more than the radius of the non-indentation-processed section 1514. However, this invention is not limited thereto.

For example, by cutting the non-indentation-processed section 1514 and the intervening section 1516, it is also possible to achieve the intervening section 1516 whose radius is less than the maximum radius of the indentation-processed section 1512 and more than the radius of the non-indentation-processed section 1514 (in this case, it is not necessary that the intervening section 1516 has the grooves 1518 formed thereon).

However, the above-mentioned embodiment is more desirable in achieving easily the intervening section 1516 whose radius is less than the maximum radius of the indentation-processed section 1512 and is more than the radius of the non-indentation-processed section 1514.

The Third Embodiment

Figure 19:
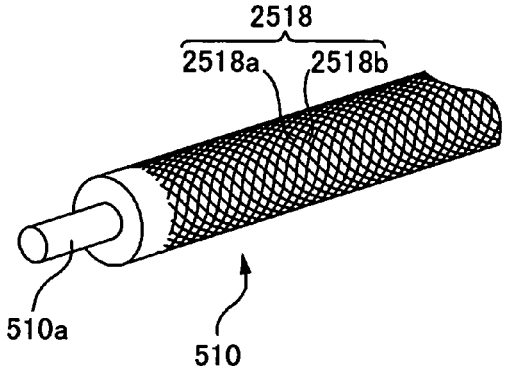
FIG. 19 is a perspective view of a schematic diagram showing a developing roller of a developing section according to the third embodiment.
Figure 20:
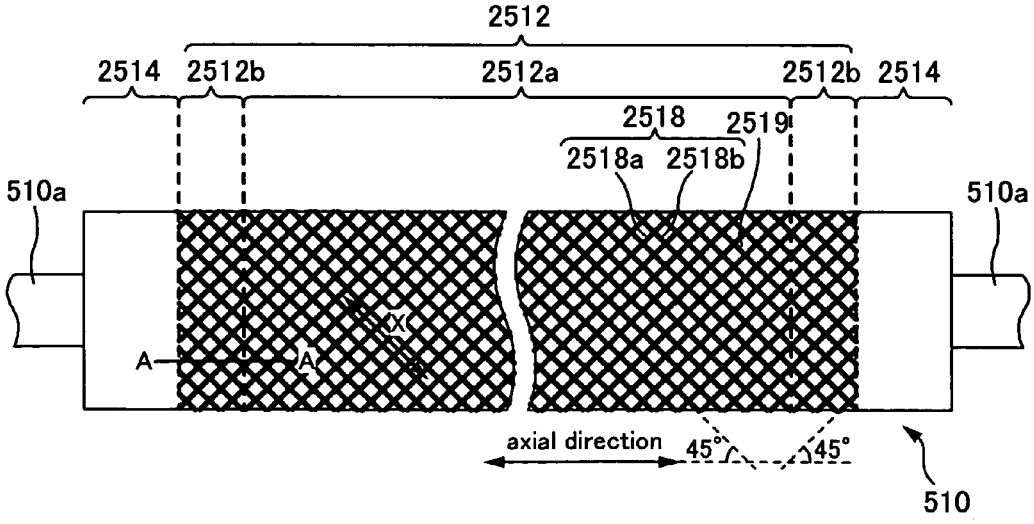
FIG. 20 is a front view of a schematic diagram showing the developing roller of the developing section according to the third embodiment.
Figure 21:
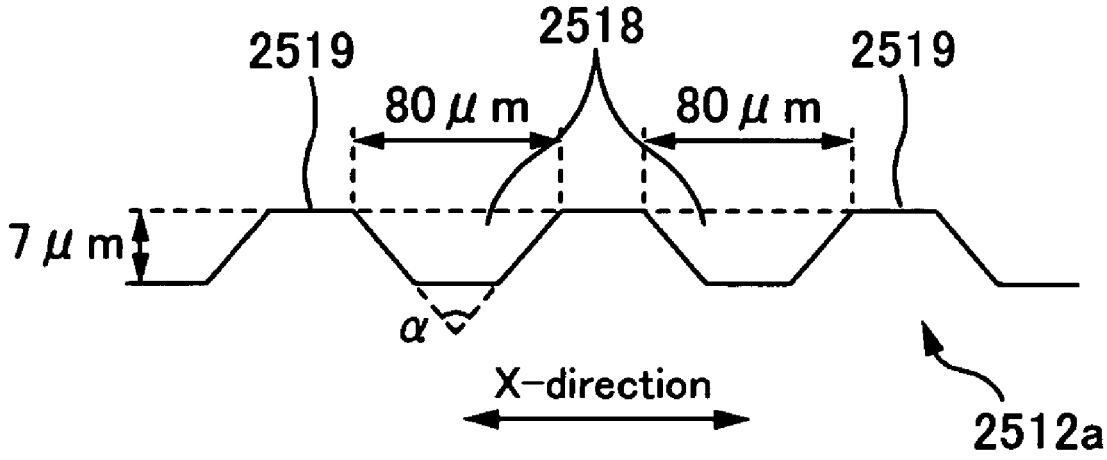
FIG. 21 is a schematic diagram showing a cross-sectional shape of grooves according to the third embodiment.
Figure 22:
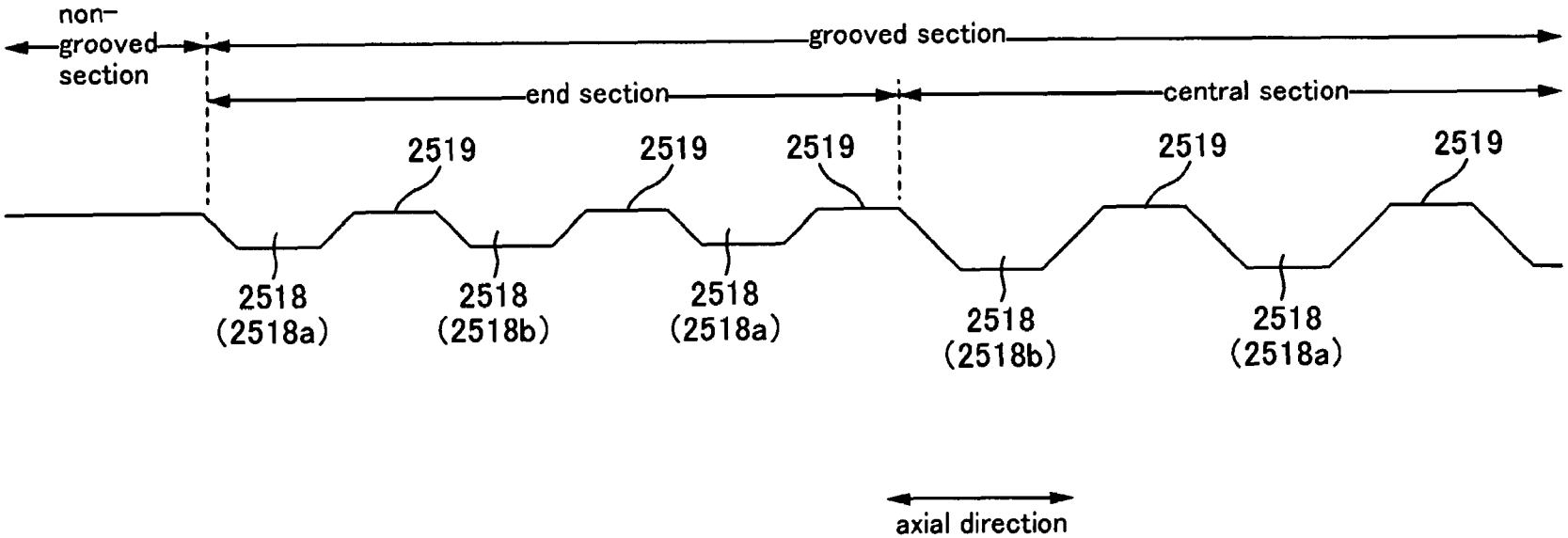
FIG. 22 is a schematic diagram showing a cross-section of FIG. 20 taken along line A-A.

Configuration Example of Developing Roller 510 of Developing Sections according to the Third Embodiment In this section, a configuration example of the developing roller 510 of the developing sections according to the third embodiment is described with reference to FIGS. 19 through 22. FIG. 19 is a perspective view of a schematic diagram of the developing roller 510, and is a diagram showing a helical first groove 2518*a* and a helical second groove 2518*b* which are different from each other in their respective twisting direction. FIG. 20 is a front view of a schematic diagram of the developing roller 510, and is a diagram showing a positional relationship between a grooved section 2512 and a non-grooved section 2514 of the developing roller 510. FIG. 21 is a schematic diagram showing a cross-sectional shape of grooves 2518. FIG. 22 is a schematic diagram showing a cross-section of FIG. 20 taken along line A-A, and is a diagram showing difference between the depth of the grooves 2518 of a central section 2512*a* and the depth of the grooves 2518 of both of the end sections 2512*b*. Note that, in FIGS. 19 through 22, the scale on which the grooves 1518 and the like are illustrated is different from the actual scale for the purpose of facilitating the understanding of the drawings. In addition, FIG. 21 shows a cross-section taken along a direction indicated by symbol X in FIG. 20.

The developing roller 510 of the developing section according to the third embodiment bears toner-T and carries it to the developing position opposite the photoconductor 20. The developing roller 510 is a member made of aluminum alloy, iron alloy and the like. As shown in FIGS. 20, 22, and the like, the developing roller 510 is separated into two main sections (the grooved section 2512 and the non-grooved section 2514), according to the difference of surface structure.

The grooved section 2512 is a section located in the middle in the axial direction of the developing roller 510, and the surface thereof is subjected to an indentation process in order to appropriately bear toner T. In the present embodiment, the above-mentioned rolling process is used as the above-mentioned indentation process, and recesses and projections are formed by subjecting the surface of the grooved section 2512 to the above-mentioned rolling process. More specifically, the grooves 2518 are formed in the surface of the grooved section 2512 by the rolling process, as shown in FIGS. 21, 22, etc., and therefore the grooved section 2512 has the grooves 2518 as recesses and non-grooves 2519 as projections (the grooves 2518 and the non-grooves 2519 both serve as a toner bearing section for bearing toner).

In the present embodiment, as shown in FIGS. 19 and 20, the helical first groove 2518*a* and the helical second groove 2518*b* are provided as the groove 2518 and they are different from each other in their respective twisting direction. An acute angle between the longitudinal direction of the first groove 2518*a* and the axial direction, and an acute angle between the longitudinal direction of the second groove 2518*b* and the axial direction both are approximately 45°. Note that a slight difference exists, regarding the grooves 2518 and the like, between the central section 2512*a* of the grooved section 2512 in the axial direction of the developing roller 510 and the end sections 2512*b* of the grooved section 2512 in the axial direction (both of the end sections).

In the central section 2512*a*, as shown in FIG. 21, the depth of the grooves 2518 is approximately 7 μm. In the present embodiment, since toner T is particulate (a particle) and the volume-weighted average diameter of toner T is approximately 7 μm, the depth of the grooves 2518 is substantially the same as the volume-weighted average diameter of toner T. Note that the width of the grooves 2518 in the central section 2512*a* is approximately 80 μm and that a groove angle (an angle indicated by symbol α in FIG. 21) is approximately 90°. Further, electroless Ni—P plating is provided on the surface of the central section 2512*a*.

On the other hand, the depth of the grooves 2518 on the end section 2512*b* is less than the depth of the grooves 2518 formed on the central section 2512*a*, as shown in FIG. 22 (FIG. 22 shows only three grooves 2518 as the grooves 2518 provided in the end section 2512*b* for the sake of convenience, but a greater number of the grooves 2518 than those mentioned above are actually provided in the end section 2512*b*). In the present embodiment, the depth of the grooves 2518 formed on the end section 2512*b* is approximately half the depth of the grooves 2518 formed on the central section 2512*a*. Further, unlike the central section 2512*a*, electroless Ni—P plating is not provided on the surface of the end section 2512*b*.

The non-grooved section 2514 is a section whose surface is not subjected to the above-mentioned indentation process (rolling process) and that does not have the helical grooves 2518 formed therein. The non-grooved section 2514 is located outside the grooved section 2512 in the axial direction of the developing roller 510, and its surface is smooth (the ten-point average height of irregularities Rz of the surface is 1 μm or less). Note that electroless Ni—P plating is not provided on the surface of the non-grooved section 2514 as well as the end section 2512*b*.

Note that, as mentioned above, in the developing roller 510 according to the present embodiment, the depth of the groove 2518 is different between the central section 2512*a* and the end section 2512*b* of the grooved section 2512, and that the depth of the grooves 2518 can be made to differ by changing the pressing force which causes a die to press a not-yet-rolled developing roller when the above-mentioned rolling is performed (i.e., making the pressing force weaker in order to make the depth of the grooves 2518 small, and making the pressing force stronger in order to make the depth of the grooves 2518 large).

Regarding Effectiveness of Developing Sections according to the Third Embodiment As mentioned above, the developing device according to the present embodiment includes the developing roller 510 that is for bearing toner and includes the grooved section 2512 on whose surface the helical groove 2518 is formed, the depth of the groove 2518 formed on the end section 2512*b*, of the above-mentioned grooved section 2512, in the axial direction of the developing roller 510 being less than the depth of the groove 2518 formed on the central section 2512*a*, of the above-mentioned grooved section 2512, in the axial direction, and the non-grooved section 2514 that is located outside the grooved section 2512 in the axial direction and on which the helical groove 2518 is not formed; and the developing device further includes the end-section seal 527 that is for preventing spillage of toner by contacting the non-grooved section 2514 along the circumferential surface of the developing roller 510. This enables to achieve a developing device and the like which appropriately prevents toner spillage.

In other words, in the above-mentioned developing device, it is necessary to prevent toner spillage from between the housing 540, etc. of the developing device and the circumferential surface of the developing roller 510, and the developing device is furnished, for the above-mentioned purpose, with the end-section seals 527 which are for preventing toner spillage by contacting the non-grooved section 2514 along the circumferential surface of the developing roller 510.

However, only providing the end-section seal 527 on the developing device may not be a measure sufficient to prevent toner spillage. Therefore, there is a demand to establish another measure to prevent toner spillage.

In contrast, in the present embodiment, the above-mentioned measure for preventing toner spillage is achieved by, among the helical grooves 2518 formed on the surface of the grooved section 2512, making the grooves 2518 formed on the end section 2512*b* different from the grooves 2518 formed on the central section 2512*a*. More specifically, in the present example, unlike a heretofor example (an example in which the helical grooves 2518 are not different between the central section 2512*a* and the end section 2512*b*), an amount of toner being in the grooves 2518 formed on the end section 2512*b* and moving towards the non-grooved section 2514 along the grooves 2518 is smaller than an amount of toner in the above-mentioned heretofor example. The reason is because the depth of the grooves 2518 formed on the end section 2512*b* is less than the depth of the grooves 2518 formed on the central section 2512*a*. Accordingly, in the present example, an amount of toner having reached the end-section seal 527 which is in contact with the non-grooved section 2514 is smaller than in the heretofor example, and thus, it becomes possible to appropriately prevent toner spillage.

Regarding Other Methods of Preventing Toner Spillage

As another method of preventing toner spillage, the above-mentioned section describes the method in which, among the helical grooves 2518 formed on the surface of the grooved section 2512, the grooves 2518 formed on the end section 2512*b* are made different from the grooves 2518 formed on the central section 2512*a*, that is, the method in which the depth of the grooves 2518 formed on the end section 2512*b* is made less than the depth of the grooves 2518 formed on the central section 2512*a* (the foregoing example). However, the foregoing example is one example of methods of preventing toner spillage by making the grooves 2518 formed on the end section 2512*b* different from the grooves 2518 formed on the central section 2512*a*, and other examples can also be considered. This section describes other examples of methods of preventing toner spillage by making the grooves 2518 formed on the end section 2512*b* different from the grooves 2518 formed on the central section 2512*a* (the first modified example and the second modified example).

Regarding the First Modified Example

Figure 23:
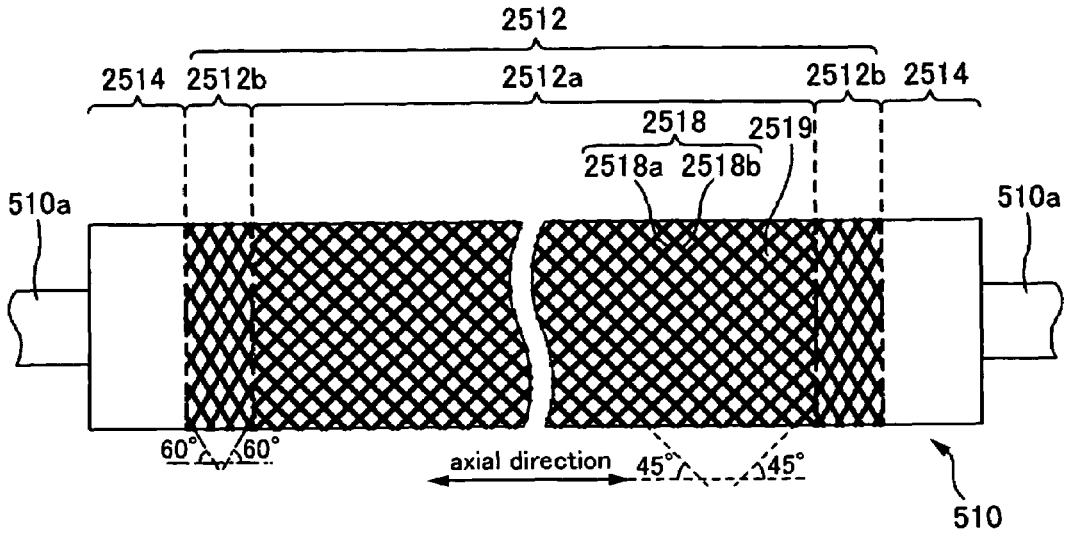
FIG. 23 is a front view of a schematic diagram showing a developing roller according to the first modified example of the third embodiment.
Figure 24:
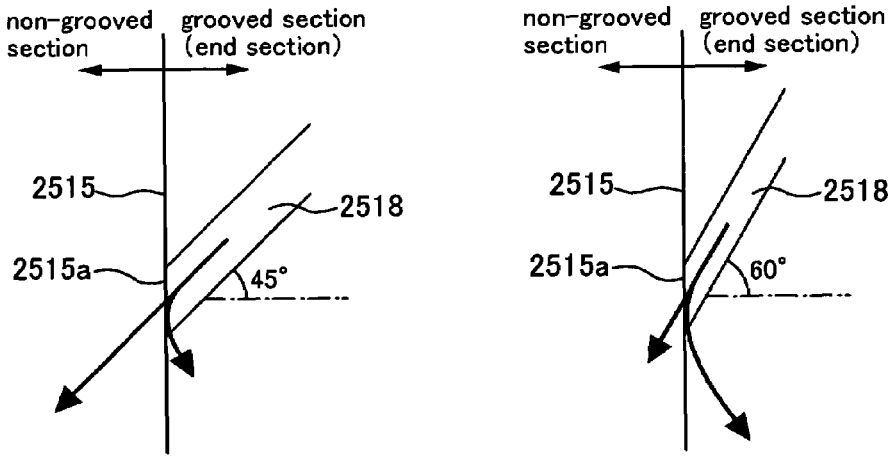
FIG. 24 is an explanatory diagram for describing effectiveness of the first modified example of the third embodiment.

First, the first modified example is described with reference to FIGS. 23 and 24. FIG. 23 corresponds to FIG. 6, and is a front view of a schematic diagram showing the developing roller 510 according to the first modified example. FIG. 24 will be described later.

As shown in FIG. 23, in the developing roller 510 according to the first modified example, an acute angle between the axial direction of the developing roller 510 and the longitudinal direction of the grooves 2518 formed on the end section 2512*b* is larger than an acute angle between the above-mentioned axial direction and the longitudinal direction of the grooves 2518 formed on the central section 2512*a*.

More specifically, in the developing roller 510 according to the foregoing example, between the case of the central section 2512*a* and the case of the end section 2512*b*, there is no difference in the acute angles between the above-mentioned axial direction and the longitudinal direction of the grooves 2518, and the foregoing acute angle is approximately 45°. However, in the developing roller 510 according to the first modified example, while the acute angle between the above-mentioned axial direction and the longitudinal direction of the grooves 2518 formed on the central section 2512*a* is approximately 45° in the same way as the foregoing example, the acute angle between the axial direction and the longitudinal direction of the grooves 2518 formed on the end section 2512*b* is approximately 60° (>45°).

By making larger the acute angle between the axial direction and the longitudinal direction of the grooves 2518 formed on the end section 2512*b* as mentioned above, it is possible to appropriately prevent toner spillage. This is described with reference to FIG. 24. FIG. 24 is an explanatory diagram for describing effectiveness of the first modified example, and is a schematic diagram showing movement of toner near a boundary 2515 between the non-grooved section 2514 and the end section 2512*b* (the movement of toner is indicated by arrows in FIG. 24). The left diagram of FIG. 24 shows an example in the case where the acute angle is small (45°) (comparison example), and the right diagram of FIG. 24 shows an example (that is, the first modified example) in the case where the acute angle is large (60°).

Toner in the grooves 2518 formed on the end section 2512*b* can move towards the non-grooved section 2514 along the grooves 2518. However, as a result of its movement along the grooves 2518, toner which has reached the boundary 2515 and is in the grooves 2518 moves out of the grooves 2518 because no groove 2518 is formed on the non-grooved section 2514, the boundary 2515 being between the non-grooved section 2514 and the end section 2512*b*. Then, as shown in FIG. 24, toner moving out of the grooves 2518 separates into the following: toner which moves towards the non-grooved section 2514 beyond a wall 2515*a* located on the boundary, and toner which is bounced against the wall 2515*a* and moves towards the end section 2512*b*. When comparing the first modified example with the comparison example, an amount of toner moving towards the non-grooved section 2514 in the first modified example is smaller, due to the above-mentioned difference in the acute angle, than an amount of toner moving towards the non-grooved section 2514 in the comparison example (on the contrary, an amount of toner moving towards the end section 2512*b* in the first modified example is larger than an amount of toner moving towards the end section 2512*b* in the comparison example). Accordingly, in the first modified example, an amount of toner having reached the end-section seal 527 which is in contact with the non-grooved section 2514 is smaller than in the case of the comparison example, and this enables to appropriately prevent toner spillage.

Note that, as mentioned above, in the developing roller 510 according to the first modified example, between the case of the central section 2512*a* and the case of the end section 2512*b* of the grooved section 2512, the acute angles between the longitudinal direction of the grooves 2518 and the axial direction of the developing roller 510 are different in degree. It is possible to make the above-mentioned acute angles different in degree by differing a die to be used in rolling for the central section 2512*a* from a die to be used in rolling for the end section 2512*b* (more specifically, by differing shapes of edges).

Besides, in the first modified example, in the same way as the foregoing example, the first groove 2518*a* and the second groove 2518*b* are formed, as the helical grooves 2518, on the grooved section 2512 and are different from each other in their respective twisting direction. However, this invention is not limited thereto. For example, in either of the foregoing example and the first modified example, it is possible to provide only either one of the first groove 2518*a* and the second groove 2518*b*.

Regarding the Second Modified Example

Figure 25:
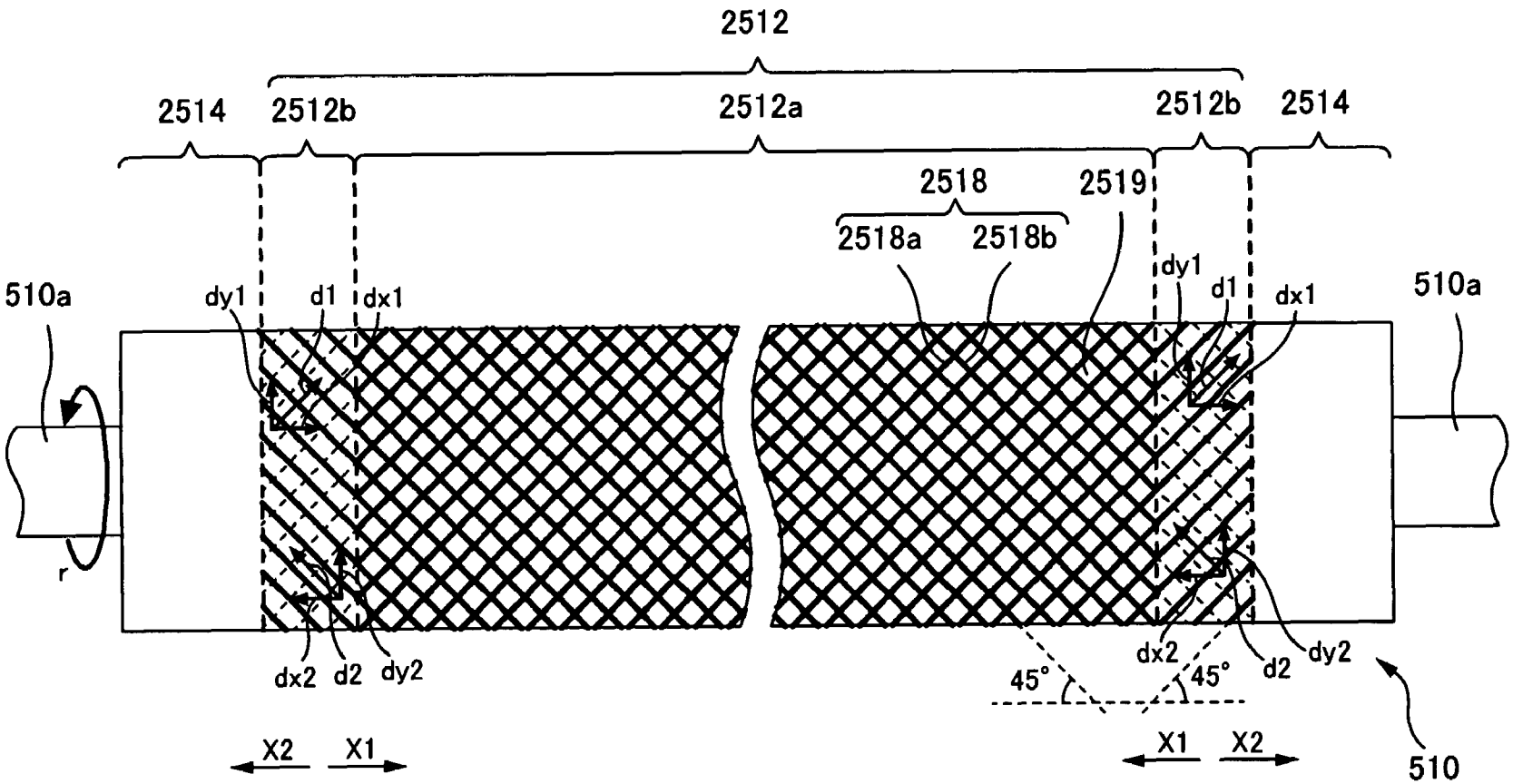
FIG. 25 is a front view of a schematic diagram showing a developing roller according to the second modified example of the third embodiment.

Next, the second modified example is described with reference to FIG. 25. FIG. 25 is a diagram corresponding to FIG. 6, and is a front view of a schematic diagram of the developing roller 510 according to the second modified example. Note that, in FIG. 25, first orientations which will be described later are indicated by symbols d1 and d2. Further, directions, of the first orientations d1 and d2, which are along the axial direction of the developing roller 510 are indicated by symbols dx1 and dx2, and directions, of the first orientations d1 and d2, which are along the circumferential direction of the developing roller 510 are indicated by symbols dy1 and dy2.

As shown in FIG. 25, in the developing roller 510 according to the second modified example, while the above-mentioned first groove 2518*a* and second groove 2518*b* which are different from each other in their respective twisting direction are formed on the central section 2512*a* as the helical grooves 2518, only either one of the first groove 2518*a* and the second groove 2518*b* is formed on the end section 2512*b* (in FIG. 25, among the first groove 2518*a* and the second groove 2518*b*, the groove 2518 which is formed on the end section 2512*b* is indicated by a solid line, and the groove 2518 which is not formed on the end section 2512*b* is indicated by a dashed line).

More specifically, among two orientations which are along the longitudinal direction of the groove 2518 formed on the end section 2512*b* and which are oriented in opposite directions from one another, the orientation whose direction along the circumferential direction of the developing roller 510 is the same as the rotating direction of the developing roller 510 (the rotating direction is indicated by a symbol r in FIG. 25) is defined as a first orientation (a first orientation with respect to the first groove 2518*a* and a first orientation with respect to the second groove 2518*b* are indicated respectively by symbols d1 and d2, in FIG. 25). In this case, the end section 2512*b* is furnished with, as the groove 2518, either one of the first groove 2518*a* and the second groove 2518*b*, whichever a direction, of their respective first orientations d1 and d2, which is along the axial direction of the developing roller 510 is the same as a direction from the end section 2512*b* towards the non-grooved section 2514 (the direction is indicated by a symbol X2 in FIG. 25), not the same as a direction from the end section 2512*b* towards the central section 2512*a* (the direction is indicated by a symbol X1 in FIG. 25).

More specifically, in the end section 2512*b* located on the left side in FIG. 25, the direction dx1, of the first orientation d1 with respect to the first groove 2518*a*, which is along the axial direction is the same as the direction X1 from the end section 2512*b* towards the central section 2512*a*. And, the direction dx2, of the first orientation d2 with respect to the second groove 2518*b*, which is along the axial direction is the same as the direction X2 from the end section 2512*b* towards the non-grooved section 2514. Therefore, the groove 2518 which meets the above-mentioned requirement is the second groove 2518*b*. Accordingly, among the first groove 2518*a* and the second groove 2518*b*, only the second groove 2518*b* is formed on the end section 2512*b* located on the left side in FIG. 25.

On the other hand, in the end section 2512*b* located on the right side in FIG. 25, the direction dx1, of the first orientation d1 with respect to the first groove 2518*a*, which is along the axial direction is the same as the direction X2 from the end section 2512*b* towards the non-grooved section 2514. And, the direction dx2, of the first orientation d2 with respect to the second groove 2518*b*, which is along the axial direction is the same as the direction X1 from the end section 2512*b* towards the central section 2512*a*. Therefore, the groove 2518 which meets the above-mentioned requirement is the first groove 2518*a*. Accordingly, among the first groove 2518*a* and the second groove 2518*b*, only the first groove 2518*a* is formed on the end section 2512*b* located on the right side in FIG. 25.

Forming the groove 2518 on the end section 2512*b* as mentioned above enables to appropriately prevent toner spillage. More specifically, if the groove 2518 which does not meet the above-mentioned requirement (which is indicated by a dashed line in FIG. 25: the first groove 2518*a* of the end section 2512*b* located on the left side in FIG. 25 and the second groove 2518*b* of the end section 2512*b* located on the right side in FIG. 25) is formed on the end section 2512*b*, when the developing roller 510 rotates in the rotating direction r, toner in the groove 2518 formed on the end section 2512*b* moves towards the non-grooved section 2514 along the groove 2518 (in the end section 2512*b* located on the left side in FIG. 25, a movement direction of toner is opposite the first orientation d1, and in the end section 2512*b* located on the right side in FIG. 25, a movement direction of toner is opposite a second orientation d2).

In contrast, if the groove 2518 which meets the above-mentioned requirement (which is indicated by a solid line in FIG. 25: the second groove 2518*b* of the end section 2512*b* located on the left side in FIG. 25 and the first groove 2518*a* of the end section 2512*b* located on the right side in FIG. 25) is formed on the end section 2512*b*, an amount of toner having reached the end-section seal 527 which is in contact with the non-grooved section 2514 decreases so that toner spillage is appropriately prevented. The reason is because, when the developing roller 510 rotates in the rotating direction r, toner in the groove 2518 formed on the end section 2512*b* moves towards a direction opposite to the non-grooved section 2514 (that is, towards the central section 2512*a*) along the groove 2518 (in the end section 2512*b* located on the left side in FIG. 25, a movement direction of toner is opposite the second orientation d2, and in the end section 2512*b* located on the right side in FIG. 25, a movement direction of toner is opposite the first orientation d1).

Note that, as mentioned above, in the developing roller 510 according to the second modified example, while the central section 2512*a* has the first groove 2518*a* and the second groove 2518*b* formed thereon, the end section 2512*b* located on the left side in FIG. 25 has only the second groove 2518*b* formed thereon, and the end section 2512 located on the right side in FIG. 25 has only the first groove 2518*a* formed thereon. The developing roller 510 according to the second modified example is achievable if the grooves 2518 are formed by both dies in the central section 2512*a*, and if the grooves 2518 are formed by only one of the dies in the end section 2512*b* located on the left side in FIG. 25 and by only the other die in the end section 2512*b* located on the right side in FIG. 25.

Other Embodiments according to the Third Embodiment

In the above description, while the surface of the central section 2512*a* is plated, the surface of the end section 2512*b* is not plated. However, this invention is not limited thereto. For example, both of the surface of the central section 2512*a* and the surface of the end section 2512*b* can be plated.

Plating the surface of the developing roller 510 improves the capability of the toner of being charged due to improvement of the capability of the toner to roll. However, if the surface of the end section 2512*b* is plated as mentioned above, as well as the surface of the central section 2512*a*, toner becomes more likely to move to the non-grooved section 2514 due to the above-mentioned improvement of capability to roll, the non-grooved section 2514 being in contact with the end-section seal 527 which is for preventing toner spillage (in other words, being necessary to obstruct toner).

In the above-mentioned embodiment, by improving the capability of the toner of being charged and by suppressing movement of toner towards the non-grooved section 2514, it is possible to appropriately prevent toner spillage because, among the surfaces of the central section 2512*a* and the end section 2512*b*, only the former is plated and the latter is not plated. Considering this point, the above-mentioned embodiment is more desirable.

The Fourth Embodiment

Figure 26:
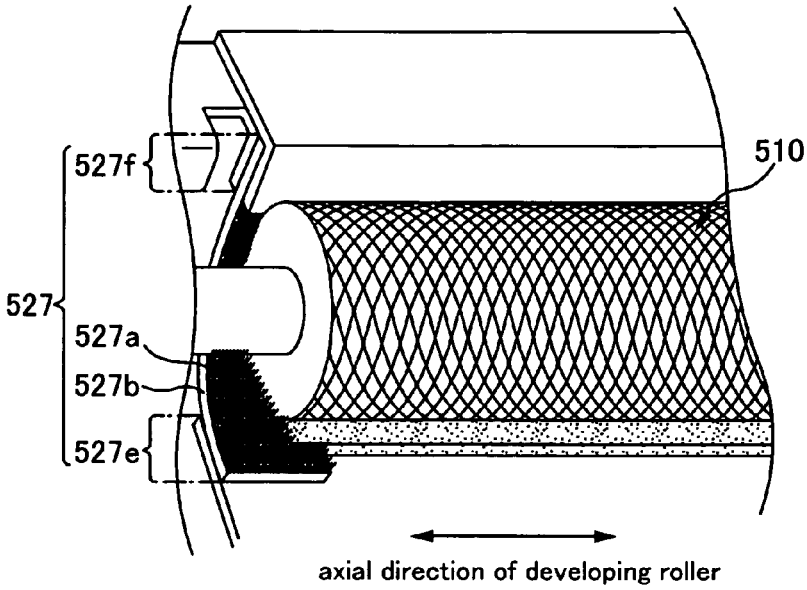
FIG. 26 is a magnified view showing a vicinity of an end section of a grooved section according to the fourth embodiment.
Figure 27:
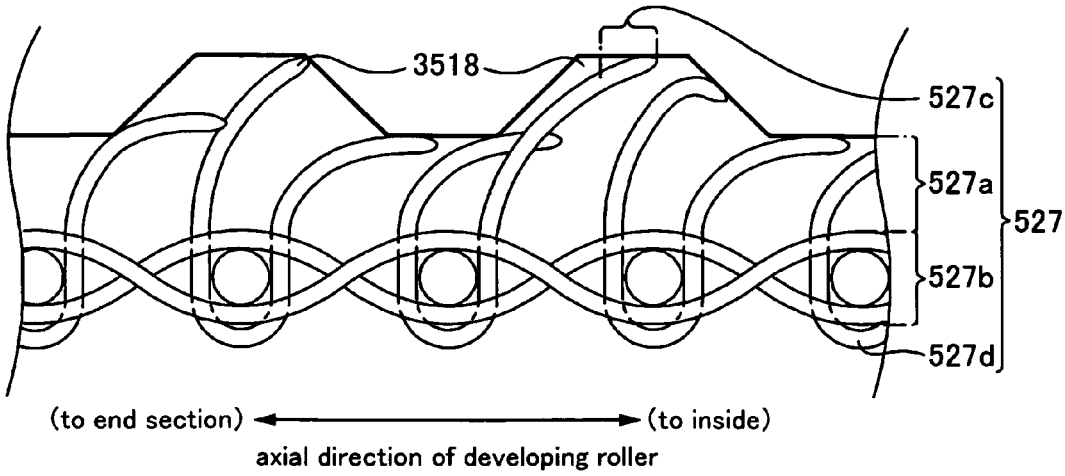
FIG. 27 is a diagram showing how pile yarns are in contact with the grooved section of a developing roller according to the fourth embodiment.

In the above-mentioned embodiments (including the second and the third embodiments), the end-section seals 527 are provided such that they abut against both of the end sections which are sections of the surface of the developing roller 510 and which do not have groove portions. However, this invention is not limited thereto. For example, as shown in FIGS. 26 and 27, the end-section seals 527 can be provided such that they abut against a grooved section which is a section of the developing roller 510 and on which grooves 3518 are formed. FIG. 26 is a magnified view showing a vicinity of the end section of the grooved section according to the fourth embodiment. FIG. 27 is a diagram showing how pile yarns contact the grooved section of the developing roller according to the fourth embodiment.

Further, in such a case, it is desirable that a surface of the end-section seal 527 in contact with the grooved section is made of woven fabric, not nonwoven fabric.

In the present embodiment, the end-section seal 527 is a member made of woven fabric, and pile fabric is used as woven fabric. Besides, a surface of base cloth 527*b* included in the pile fabric is furnished with pile yarn 527*a* made of fluorocarbon fiber with the pile yarn 527*a* being tufted, and the pile yarn 527*a* is in contact with the grooved section of the developing roller. Further, the pile yarn 527*a* is interwoven with base yarn of the base cloth 527*b* such that the pile yarn 527*a* is arranged on a surface of the base cloth 527*b* at substantially even density (that is, a base-cloth-side end section 527*d* of the pile yarn 527*a* is located opposite a tip end 527*c* of the pile yarn 527*a* through the base cloth 527*b*, as shown in FIG. 27). Further, the pile fabric is subjected to pressing, and as shown in FIG. 27, the pile yarn 527*a* is inclined such that the tip end 527*c* thereof points towards the inside of the grooved section, without standing straight on the surface of the base cloth 527*b*. Note that, in the present embodiment, the pile yarn 527*a* is cut pile (cut) in shape, but this invention is not limited thereto. For example, the pile yarn 527*a* can be loop pile (uncut) in shape. In addition, in the present embodiment, the end-section seal 527 is a member made of only woven fabric, but this invention is not limited thereto. It is only necessary that a surface, of the end-section seal 527, which contacts the grooved section of the developing roller 510 is made of woven fabric. It is also acceptable to use an end-section seal 527 in which nonwoven fabric, etc., as a thickness adjusting member, is combined with the woven fabric depending on a clearance between the developing roller 510 and the housing 540.

Next, effectiveness of the fourth embodiment is described.

If the end-section seal 527 which is made of nonwoven fabric contacts the grooved section, the developing roller 510 slides in contact with a surface of the end-section seals 527 while the developing roller 510 is pressing the end-section seals 527. Therefore, recesses and projections of the grooved section rub the surface of the end-section seals 527, so that fiber on the surface becomes more likely to loosen or fall off. As a result thereof, the end-section seals 527 may not be able to prevent appropriately toner T from spilling.

In contrast, if the surface, of the end-section seals 527, which contacts the grooved section is made of woven fabric, all fibers included in the woven fabric are interwoven, so that falling off of fiber caused by the friction is prevented and the end-section seals 527 appropriately prevent toner T from spilling.

Besides, in the present embodiment, the woven fabric, of the end-section seal 527, which contacts the grooved section of the developing roller 510 is pile fabric. The pile yarn 527*a* interwoven with the base cloth 527*b* included in the pile fabric is in contact with the grooved section. In such a case, the pile yarn 527*a* can contact the grooved section by satisfactorily following the recesses and projections of the grooved section. In addition, since contact pressure with the grooved section is low, the end-section seal 527 can have sealing function with keeping driving torque of the developing roller 510 low. Accordingly, the end-section seal 527 prevents toner T from spillage more appropriately.

Further, the pile yarn 527*a* is in contact with both end sections, of the grooved section, in the axial direction of the developing roller 510, and the pile yarn 527*a* (that is, the tip end 527*c* of the pile yarn 527*a*) points inwardly with respect to the axial direction. In this case, the pile yarn 527*a* can catch toner T which is moving towards the end sections of the grooved section. The reason is because toner T moving towards the end sections is positioned opposite the tip end 527*c* of the pile yarn 527*a*, so that toner T becomes more likely to be caught by the pile yarn 527*a*. On the other hand, toner T caught by the pile yarn 527*a* is turned back towards the inward direction because the toner T is likely to move in a direction of the pile yarn 527*a*. This enables the end-section seal 527 to prevent spillage of toner T more appropriately.

Configuration of Image Forming System etc.

Next, embodiments of an image forming system, which is an example of an embodiment according to the present invention, are described with reference to the drawings.

Figure 28:
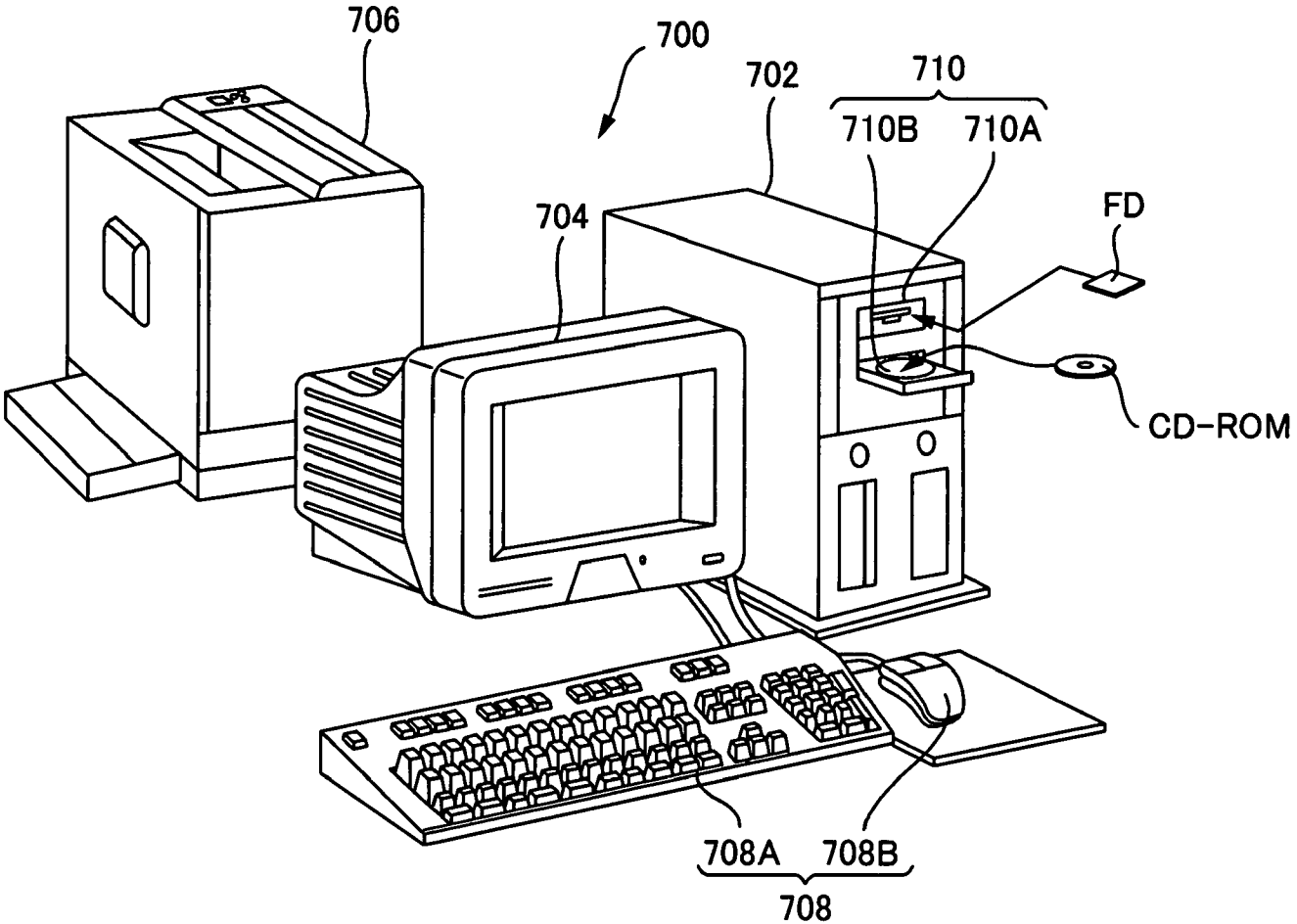
FIG. 28 is an explanatory diagram showing an external structure of an image forming system.

FIG. 28 is an explanatory drawing showing an external structure of an image forming system. The image forming system 700 includes a computer 702, a display device 704, a printer 10, input devices 708, and reading devices 710.

In the present embodiment, the computer 702 is accommodated in a mini-tower type enclosure, but this invention is not limited thereto. A CRT (Cathode Ray Tube), a plasma display, or a liquid crystal display device, for example, is generally used as the display device 704, but this invention is not limited thereto. The printer described above is used as the printer 10. In this embodiment, a keyboard 708A and a mouse 708B are used as the input device 708, but this is not a limitation. For the reading devices 710 in the present embodiment, a flexible disk drive device 710A and a CD-ROM drive device 710B are used, but this invention is not limited thereto, and other devices such as an MO (Magneto Optical) disk drive device or a DVD (Digital Versatile Disk) may be used.

Figure 29:
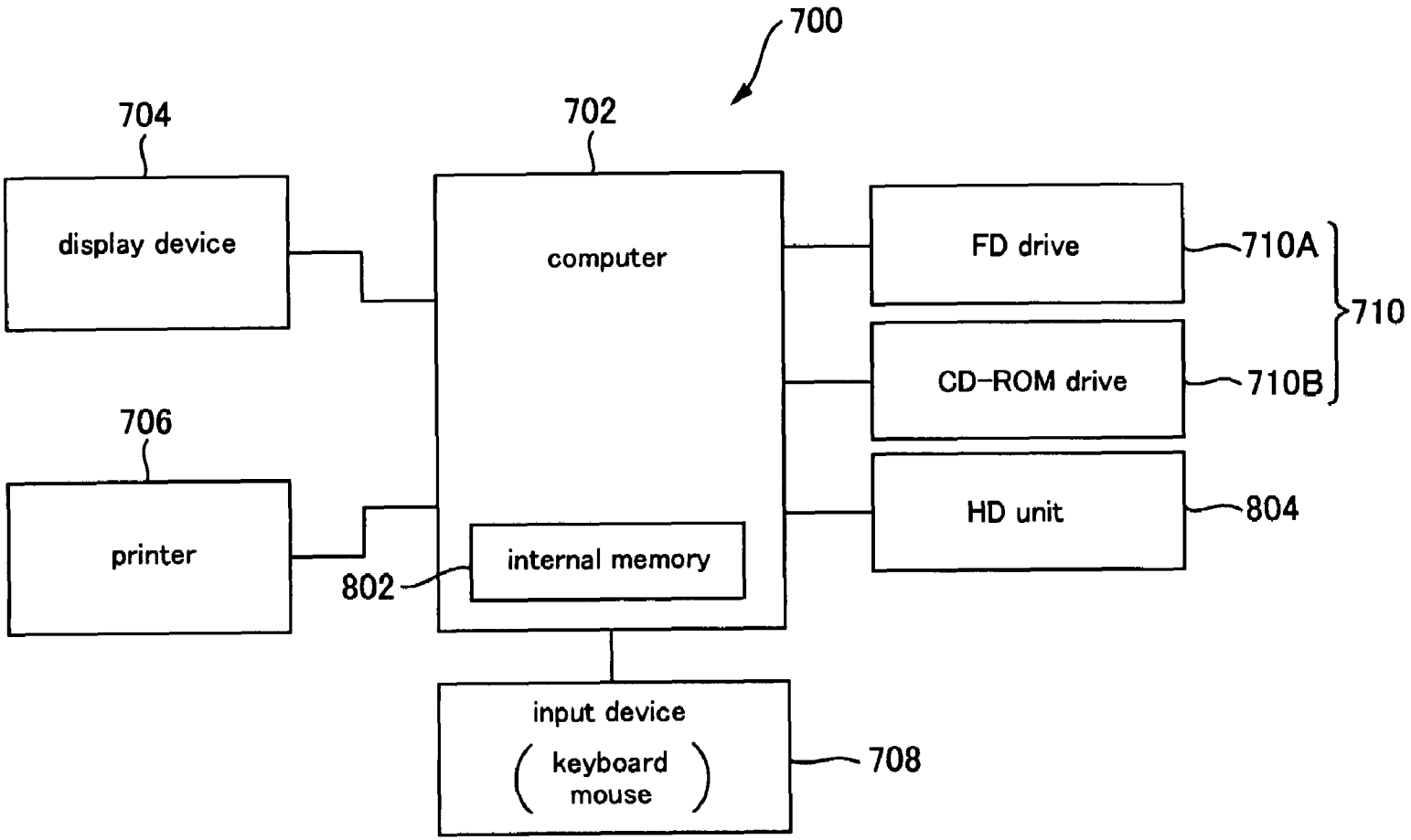
FIG. 29 is a block diagram showing a configuration of the image forming system shown in FIG. 28.

FIG. 29 is a block diagram showing a configuration of the image forming system shown in FIG. 28. Further provided are an internal memory 802 such as a RAM inside the housing accommodating the computer 702, and an external memory such as a hard disk drive unit 804.

Note that, in the above description, an example in which the image forming system is structured by connecting the printer 10 to the computer 702, to the display device 704, to the input devices 708, and to the reading devices 710 was described, but this invention is not limited thereto. For example, the image forming system can be configured by the computer 702 and the printer 10, and the image forming system does not have to be furnished with any one of the display device 704, the input devices 708, and the reading devices 710.

Further, for example, the printer 10 can have some of the functions or mechanisms of the computer 702, the display device 704, the input devices 708, and the reading devices 710. As an example, the printer 10 can be configured so as to have an image processing section for carrying out image processing, a displaying section for carrying out various types of displays, and a recording media attach/detach section to and from which recording media storing image data captured by a digital camera or the like are inserted and taken out.

As an overall system, the image forming system that is achieved in this way becomes superior to heretofor systems.

What is claimed is:

1. A developing device comprising:

a container that contains toner particles that are for developing a latent image borne by an image bearing body; and a toner-particle bearing roller that has a helical groove portion on a surface thereof that is for bearing the toner particles, the helical groove portion having an inclination with respect to an axial direction and a circumferential direction of the toner-particle bearing roller and being formed having a uniform pitch in the axial direction, wherein:

the latent image includes dot-like latent images which are formed respectively in regions divided into lattices;

the lattices can be formed having a plurality of types of pitches in the axial direction; and a pitch of the groove portion in the axial direction is shorter than a longest pitch among a plurality of the types of the pitches of the lattices.

2. A developing device comprising:

a container that contains toner particles that are for developing a latent image borne by an image bearing body; and a toner-particle bearing roller that has a helical groove portion on a surface thereof that is for bearing the toner particles, the helical groove portion having an inclination with respect to an axial direction and a circumferential direction of the toner-particle bearing roller and being formed having a uniform pitch in the axial direction, wherein:

the toner-particle bearing roller includes both end sections that are not to be processed and a central section, the central section having the groove portion that is provided in a depressed condition by a tool and having a projection portion that has a surface not contacted by the tool; and the developing device further comprises a layer-thickness restriction member that is for restricting a layer thickness of the toner particles borne by the toner-particle bearing roller, by abutting against the toner-particle bearing roller contiguously from the central section to both of the end sections.

3. A developing device according to claim 2, wherein:

two types of the groove portions are formed, an angle of the inclination of each of the types being different with respect to the axial direction and the circumferential direction.

4. A developing device according to claim 2, wherein:

a distance from a top surface of the projection portion to a bottom surface of the groove portion is uniform.

5. A developing device according to claim 4, wherein:

the distance from the top surface of the projection portion to the bottom surface of the groove portion is not more than twice as much as a volume-weighted average diameter of the toner particles.

6. A developing device comprising:

a container that contains toner particles that are for developing a latent image borne by an image bearing body; and a toner-particle bearing roller that has a helical groove portion on a surface thereof that is for bearing the toner particles, the helical groove portion having an inclination with respect to an axial direction and a circumferential direction of the toner-particle bearing roller and being formed having a uniform pitch in the axial direction, wherein:

the toner-particle bearing roller includes an indentation-processed section that is located on a central section in the axial direction of the toner-particle bearing roller, and whose surface is subjected to an indentation process in order to bear the toner particles, a non-indentation-processed section that is located on both end sections in the axial direction of the toner-particle bearing roller, and whose surface is not subjected to the indentation process, and an intervening section that is located between the indentation-processed section and the non-indentation-processed section in the axial direction of the toner-particle bearing roller, and whose radius is less than a maximum radius of the indentation-processed section and is more than a radius of the non-indentation- processed section; and the developing device further comprises a layer-thickness restriction member that is for restricting a layer thickness of the toner particles borne by the toner-particle bearing roller, by abutting against the toner-particle bearing roller contiguously from one of the end sections in the axial direction of the toner-particle bearing roller to the other of the end sections.

7. A developing device according to claim 6, wherein:

the radius of the intervening section is large on a side close to the indentation-processed section of the intervening section and is small on a side close to the non-indentation-processed section of the intervening section.

8. A developing device according to claim 7, wherein:

the radius of the intervening section becomes gradually smaller from the side close to the indentation-processed section of the intervening section to the side close to the non-indentation-processed section thereof.

9. A developing device according to claim 6, wherein:

the developing device further comprises a sealing member that is for preventing spillage of the toner particles by contacting the non-indentation- processed section along a circumferential surface of the toner-particle bearing roller; and a surface of the intervening section is not plated while a surface of the indentation-processed section is plated.

10. A developing device comprising:

a container that contains toner particles that are for developing a latent image borne by an image bearing body; and a toner-particle bearing roller that has a helical groove portion on a surface thereof that is for bearing the toner particles, the helical groove portion having an inclination with respect to an axial direction and a circumferential direction of the toner-particle bearing roller and being formed having a uniform pitch in the axial direction, wherein:

the toner-particle bearing roller includes a grooved section on whose surface the groove portion is formed, a depth of the groove portion formed on an end section, of the above-mentioned grooved section, in the axial direction of the toner-particle bearing roller being less than a depth of the groove portion formed on a central section, of the above-mentioned grooved section, in the axial direction, and a non-grooved section that is located outside the grooved section in the axial direction and on which the groove portion is not formed; and the developing device further comprises a sealing member that is for preventing spillage of the toner particles by contacting the non-grooved section along a circumferential surface of the toner-particle bearing roller.

11. A developing device according to claim 10, wherein:

while a surface of the central section is plated, a surface of the end section is not plated.

12. A developing device comprising:

a container that contains toner particles that are for developing a latent image borne by an image bearing body; and a toner-particle bearing roller that has a helical groove portion on a surface thereof that is for bearing the toner particles, the helical groove portion having an inclination with respect to an axial direction and a circumferential direction of the toner-particle bearing roller and being formed having a uniform pitch in the axial direction, wherein:

the toner-particle bearing roller includes a grooved section on whose surface the groove portion is formed, an acute angle between the axial direction of the toner-particle bearing roller and a longitudinal direction of the groove portion formed on an end section of the grooved section in the axial direction being larger than an acute angle between the axial direction and a longitudinal direction of the groove portion formed on a central section of the grooved section in the axial direction, and a non-grooved section that is located outside the grooved section in the axial direction and on which the groove portion is not formed; and the developing device further comprises a sealing member that is for preventing spillage of the toner particles by contacting the non-grooved section along a circumferential surface of the toner-particle bearing roller.

13. A developing device comprising:

a container that contains toner particles that are for developing a latent image borne by an image bearing body; and a toner-particle bearing roller that has a helical groove portion on a surface thereof that is for bearing the toner particles, the helical groove portion having an inclination with respect to an axial direction and a circumferential direction of the toner-particle bearing roller and being formed having a uniform pitch in the axial direction, wherein:

the toner-particle bearing roller rotates in a predetermined rotating direction;

the toner-particle bearing roller includes a grooved section on whose surface the groove portion is formed, wherein a first groove portion and a second groove portion that are different from each other in their respective twisting directions are formed as the groove portion in a central section, of the grooved section, in the axial direction of the toner-particle bearing roller, and wherein only either one of the first groove portion and the second groove portion is formed in an end section, of the grooved section, in the axial direction, and a non-grooved section that is located outside the grooved section in the axial direction and on which the groove portion is not formed;

the developing device further comprises a sealing member that is for preventing spillage of the toner particles by contacting the non-grooved section along a circumferential surface of the toner-particle bearing roller; and when, among two orientations that are along a longitudinal direction of the groove portion formed on the end section and that are oriented in opposite directions from one another, one orientation whose direction along the circumferential direction of the toner-particle bearing roller is the same as the rotating direction is defined as a first orientation, among a direction from the end section towards the central section and a direction from the end section towards the non-grooved section, the latter is the same as a direction, of the first orientation, in the axial direction of the toner-particle bearing roller.

14. A developing device comprising:

a container that contains toner particles that are for developing a latent image borne by an image bearing body; and a toner-particle bearing roller that has a helical groove portion on a surface thereof that is for bearing the toner particles, the helical groove portion having an inclination with respect to an axial direction and a circumferential direction of the toner-particle bearing roller and being formed having a uniform pitch in the axial direction, wherein:

the toner-particle bearing roller includes a grooved section on whose surface the groove portion is formed; and the developing device further comprises a sealing member that prevents spillage of the toner particles by contacting the grooved section along a circumferential surface of the toner-particle bearing roller, and whose surface in contact with the grooved section is made of woven fabric.

15. A developing device according to claim 14, wherein:

the woven fabric is pile fabric;

pile yarns that are interwoven with base cloth of the pile fabric are in contact with the grooved section;

the pile yarns are in contact with both end sections of the grooved section in the axial direction of the developer bearing roller; and a tip end of each of the pile yarns points inwardly with respect to the axial direction.

16. An image forming apparatus, comprising:

a developing device including a container that contains toner particles that are for developing a latent image borne by an image bearing body, and a toner- particle bearing roller that has a helical groove portion on a surface thereof that is for bearing the toner particles, the helical groove portion having an inclination with respect to an axial direction and a circumferential direction of the toner-particle bearing roller and being formed having a uniform pitch in the axial direction, wherein:

the latent image includes dot-like latent images which are formed respectively in regions divided into lattices;

the lattices can be formed having a plurality of types of pitches in the axial direction; and a pitch of the groove portion in the axial direction is shorter than a longest pitch among a plurality of the types of the pitches of the lattices.

* * * * *